US007719424B2

(12) United States Patent
Steil

(10) Patent No.: US 7,719,424 B2
(45) Date of Patent: May 18, 2010

(54) TABLE MONITORING IDENTIFICATION SYSTEM, WAGER TAGGING AND FELT COORDINATE MAPPING

(75) Inventor: Rolland N. Steil, Las Vegas, NV (US)

(73) Assignee: IGT, Reno, NV (US)

( * ) Notice: Subject to any disclaimer, the term of this patent is extended or adjusted under 35 U.S.C. 154(b) by 303 days.

(21) Appl. No.: 12/009,437

(22) Filed: Jan. 18, 2008

(65) Prior Publication Data

US 2008/0180250 A1 Jul. 31, 2008

(51) Int. Cl.
*G08B 13/14* (2006.01)

(52) U.S. Cl. ..... 340/572.4; 340/572.1; 340/572.7; 235/376; 273/274; 463/25; 463/29

(58) Field of Classification Search ..... 340/572.1, 340/572.4, 572.7, 10.1, 825.22, 5.82, 10.32, 340/10.4, 10.41; 235/375, 376, 378; 463/25, 463/29; 273/274

See application file for complete search history.

(56) References Cited

U.S. PATENT DOCUMENTS

| | | | |
|---|---|---|---|
| 2,410,845 | A | 11/1946 | Snell et al. |
| 2,983,354 | A | 5/1961 | Ember et al. |
| 3,034,643 | A | 5/1962 | Keller et al. |
| 3,350,802 | A | 11/1967 | Segal |
| 3,766,452 | A | 10/1973 | Burpee et al. |
| D232,367 | S | 8/1974 | Garaventa |
| D237,724 | S | 11/1975 | Garaventa |
| D240,053 | S | 5/1976 | Garaventa |
| 3,953,932 | A | 5/1976 | Graves |
| 3,968,582 | A | 7/1976 | Jones |
| 3,983,646 | A | 10/1976 | Howard |
| 4,026,309 | A | 5/1977 | Howard |
| 4,435,911 | A | 3/1984 | Jones |
| 4,510,495 | A | 4/1985 | Sigrimis et al. |

(Continued)

FOREIGN PATENT DOCUMENTS

| | | |
|---|---|---|
| DE | P 44 39 502.7 | 11/1994 |

(Continued)

OTHER PUBLICATIONS

Bill Zender; "Card Counting For The Casino Executive"; 1990; pp. 70, 72, 74, and 76.

(Continued)

*Primary Examiner*—Toan N Pham
(74) *Attorney, Agent, or Firm*—Armstrong Teasdale LLP

(57) ABSTRACT

A table monitoring system and method for monitoring a table games. In one embodiment, the system comprises an RFID system and a processing engine. The system may include a camera, and image controller, or both. The system creates RFID data and image data in response to table events and its processing engine cross-references this data with time stamps to monitor table events such as wagers, payouts, or other occurrences. The data is associated with a tag which represents a table event. Table events are tracked during play. In one embodiment, the RFID data and image data is mapped to a coordinate grid. With the coordinate mapping and by cross-referencing this data, the system can distinguish individual table events occurring within the detection zone of a single RFID antenna such as distinguishing wagers placed on multiple bet locations within the detection zone of a single antenna.

19 Claims, 19 Drawing Sheets

U.S. PATENT DOCUMENTS

| | | | | |
|---|---|---|---|---|
| 4,531,187 | A | 7/1985 | Uhland | |
| 4,814,589 | A | 3/1989 | Storch et al. | |
| 4,939,354 | A | 7/1990 | Priddy et al. | |
| 5,088,093 | A | 2/1992 | Storch et al. | |
| 5,103,081 | A | 4/1992 | Fisher et al. | |
| 5,166,502 | A | 11/1992 | Rendleman et al. | |
| 5,216,234 | A | 6/1993 | Bell | |
| 5,283,422 | A | 2/1994 | Storch et al. | |
| 5,332,219 | A | 7/1994 | Marnell et al. | |
| 5,345,231 | A | 9/1994 | Koo et al. | |
| 5,361,885 | A | 11/1994 | Modler | |
| 5,367,148 | A | 11/1994 | Storch et al. | |
| 5,374,061 | A | 12/1994 | Albrecht | |
| 5,406,264 | A | 4/1995 | Plonsky et al. | |
| 5,423,551 | A | 6/1995 | Stavinsky | |
| D361,350 | S | 8/1995 | Nelson | |
| 5,451,756 | A | 9/1995 | Holzer et al. | |
| 5,548,106 | A | 8/1996 | Liang et al. | |
| 5,548,110 | A | 8/1996 | Storch et al. | |
| 5,549,300 | A | 8/1996 | Sardarian | |
| 5,586,936 | A | 12/1996 | Bennett et al. | |
| 5,651,548 | A | 7/1997 | French et al. | |
| 5,676,376 | A | 10/1997 | Valley | |
| 5,681,039 | A | 10/1997 | Miller | |
| 5,683,084 | A | 11/1997 | Dean et al. | |
| D387,391 | S | 12/1997 | Jones et al. | |
| 5,707,287 | A | 1/1998 | McCrea, Jr. | |
| 5,722,893 | A | 3/1998 | Hill et al. | |
| 5,735,742 | A * | 4/1998 | French | 463/25 |
| 5,772,505 | A | 6/1998 | Garczynski et al. | |
| 5,785,321 | A | 7/1998 | van Putten et al. | |
| 5,803,808 | A | 9/1998 | Strisower | |
| 5,809,482 | A | 9/1998 | Strisower | |
| 5,831,527 | A | 11/1998 | Jones et al. | |
| D402,331 | S | 12/1998 | Serowik et al. | |
| D408,868 | S | 4/1999 | Floge et al. | |
| 5,890,717 | A | 4/1999 | Rosewarne et al. | |
| 5,898,321 | A | 4/1999 | Ilkbahar et al. | |
| 5,911,626 | A | 6/1999 | McCrea | |
| 5,919,090 | A | 7/1999 | Mothwurf | |
| 5,941,769 | A | 8/1999 | Order | |
| 5,947,821 | A | 9/1999 | Stone | |
| 5,951,011 | A | 9/1999 | Potter et al. | |
| 5,957,776 | A | 9/1999 | Hoehne | |
| D420,401 | S | 2/2000 | Bayne | |
| 6,021,949 | A | 2/2000 | Boiron | |
| D421,466 | S | 3/2000 | McBride | |
| 6,039,650 | A | 3/2000 | Hill | |
| 6,059,659 | A | 5/2000 | Busch et al. | |
| 6,062,564 | A | 5/2000 | Terminel | |
| D427,644 | S | 7/2000 | Stern | |
| 6,093,103 | A | 7/2000 | McCrea, Jr. | |
| 6,126,166 | A | 10/2000 | Lorson et al. | |
| 6,165,069 | A | 12/2000 | Sines et al. | |
| 6,186,505 | B1 | 2/2001 | Perrie et al. | |
| 6,186,895 | B1 | 2/2001 | Oliver | |
| 6,210,275 | B1 | 4/2001 | Olsen | |
| D442,643 | S | 5/2001 | Florence | |
| 6,267,671 | B1 | 7/2001 | Hogan | |
| 6,299,534 | B1 | 10/2001 | Breeding et al. | |
| 6,299,536 | B1 | 10/2001 | Hill | |
| 6,319,125 | B1 | 11/2001 | Acres | |
| D452,283 | S | 12/2001 | Regan, II et al. | |
| D459,760 | S | 7/2002 | Tamura et al. | |
| 6,460,848 | B1 | 10/2002 | Soltys et al. | |
| 6,464,584 | B2 | 10/2002 | Oliver | |
| D468,367 | S | 1/2003 | Florence et al. | |
| 6,514,140 | B1 | 2/2003 | Storch | |
| 6,517,072 | B1 | 2/2003 | McInerney | |
| 6,517,073 | B1 | 2/2003 | Vancura | |
| 6,517,435 | B2 | 2/2003 | Soltys et al. | |
| 6,517,436 | B2 | 2/2003 | Soltys et al. | |
| 6,520,857 | B2 | 2/2003 | Soltys et al. | |
| 6,527,271 | B2 | 3/2003 | Soltys et al. | |
| 6,530,837 | B2 | 3/2003 | Soltys et al. | |
| 6,533,658 | B1 | 3/2003 | Walker et al. | |
| 6,533,662 | B2 | 3/2003 | Soltys et al. | |
| 6,561,897 | B1 | 5/2003 | Bourbour et al. | |
| 6,568,682 | B1 | 5/2003 | Hogan et al. | |
| 6,579,180 | B2 | 6/2003 | Soltys et al. | |
| 6,579,181 | B2 | 6/2003 | Soltys et al. | |
| 6,581,747 | B1 | 6/2003 | Charlier et al. | |
| 6,582,301 | B2 | 6/2003 | Hill | |
| 6,590,889 | B1 | 7/2003 | Preuss et al. | |
| 6,595,857 | B2 | 7/2003 | Soltys et al. | |
| 6,604,998 | B1 | 8/2003 | Singer et al. | |
| 6,609,710 | B1 | 8/2003 | Order | |
| 6,612,928 | B1 | 9/2003 | Bradford et al. | |
| 6,619,662 | B2 | 9/2003 | Miller | |
| 6,626,757 | B2 | 9/2003 | Oliveras | |
| 6,629,019 | B2 | 9/2003 | Legge et al. | |
| 6,629,591 | B1 | 10/2003 | Griswold et al. | |
| 6,629,889 | B2 | 10/2003 | Mothwurf | |
| 6,633,545 | B1 | 10/2003 | Milbrandt | |
| 6,637,746 | B1 | 10/2003 | Baranauskas | |
| 6,638,161 | B2 | 10/2003 | Soltys et al. | |
| 6,646,451 | B2 | 11/2003 | Lanan | |
| 6,647,058 | B1 | 11/2003 | Bremer et al. | |
| 6,652,379 | B2 | 11/2003 | Soltys et al. | |
| 6,659,875 | B2 | 12/2003 | Purton | |
| 6,663,490 | B2 | 12/2003 | Soltys et al. | |
| 6,671,311 | B1 | 12/2003 | Raphaeli et al. | |
| 6,671,358 | B1 | 12/2003 | Seidman et al. | |
| 6,679,492 | B2 | 1/2004 | Markowiak | |
| 6,685,564 | B2 | 2/2004 | Oliver | |
| 6,685,568 | B2 | 2/2004 | Soltys et al. | |
| 6,688,979 | B2 | 2/2004 | Soltys et al. | |
| 6,690,673 | B1 | 2/2004 | Jarvis | |
| 6,709,333 | B1 | 3/2004 | Bradford et al. | |
| 6,711,207 | B1 | 3/2004 | Amrany et al. | |
| 6,712,696 | B2 | 3/2004 | Soltys et al. | |
| 6,733,388 | B2 | 5/2004 | Mothwurf | |
| 6,747,560 | B2 | 6/2004 | Stevens, III | |
| 6,758,751 | B2 | 7/2004 | Soltys et al. | |
| 6,829,252 | B1 | 12/2004 | Lewin et al. | |
| 6,834,251 | B1 | 12/2004 | Fletcher | |
| 6,843,725 | B2 | 1/2005 | Nelson | |
| 6,848,994 | B1 | 2/2005 | Knust et al. | |
| 6,908,385 | B2 | 6/2005 | Green | |
| 6,964,416 | B2 | 11/2005 | McClintic et al. | |
| 6,964,612 | B2 | 11/2005 | Soltys et al. | |
| 6,965,205 | B2 | 11/2005 | Piepgras et al. | |
| 6,967,563 | B2 | 11/2005 | Bormaster | |
| 7,018,291 | B1 | 3/2006 | Lemke et al. | |
| 7,152,045 | B2 | 12/2006 | Hoffman | |
| 7,172,507 | B2 * | 2/2007 | Fujimoto et al. | 463/29 |
| 7,559,839 | B2 * | 7/2009 | Bahar | 463/25 |
| 2002/0084587 | A1 | 7/2002 | Bennett et al. | |
| 2002/0123376 | A1 | 9/2002 | Walker et al. | |
| 2002/0147042 | A1 | 10/2002 | Vuong et al. | |
| 2003/0064775 | A1 | 4/2003 | Fujimoto et al. | |
| 2003/0064798 | A1 | 4/2003 | Grauzer et al. | |
| 2003/0195025 | A1 | 10/2003 | Hill | |
| 2004/0207156 | A1 | 10/2004 | Soltys et al. | |
| 2005/0012269 | A1 | 1/2005 | Grauzer et al. | |
| 2005/0026682 | A1 | 2/2005 | Grauzer et al. | |
| 2005/0082750 | A1 | 4/2005 | Grauzer et al. | |
| 2005/0219599 | A1 | 10/2005 | White et al. | |
| 2005/0225080 | A1 | 10/2005 | Wicker | |
| 2005/0242506 | A1 | 11/2005 | Yoseloff | |
| 2006/0177109 | A1 | 8/2006 | Storch | |
| 2006/0252521 | A1 | 11/2006 | Gururajan et al. | |
| 2006/0258427 | A1 | 11/2006 | Rowe et al. | |
| 2006/0281537 | A1 * | 12/2006 | Abbott et al. | 463/25 |

| | | | | |
|---|---|---|---|---|
| 2007/0026204 | A1 | 2/2007 | Caulley et al. | |
| 2007/0029394 | A1 | 2/2007 | Wicker et al. | |
| 2007/0035399 | A1 | 2/2007 | Hecht et al. | |
| 2007/0057469 | A1 | 3/2007 | Grauzer et al. | |
| 2007/0060311 | A1 | 3/2007 | Rowe et al. | |
| 2009/0124379 | A1 * | 5/2009 | Wells | 463/31 |

FOREIGN PATENT DOCUMENTS

| | | |
|---|---|---|
| DE | 44 39 502 C 1 | 9/1995 |
| WO | WO 97/06865 | 2/1997 |
| WO | WO 98/18531 | 5/1998 |
| WO | WO 00/22585 | 4/2000 |
| WO | WO 06/037220 | 4/2006 |

OTHER PUBLICATIONS hitag System Overview, Brochure, Oct. 1996, 29 pages, Mikron Identification.

"TableLink™ The New Standard in Table Games"; Mikohn; Brochure, 18 pages; 1999.

Alien Technology, 915 MHz RFID Tag, Internet Advertising Literature, 2002, Alien Technology, Morgan Hills, CA.

International Gaming & Wagering Business, Table Game Trends 2004; 22 pages.

Table® Max, www.tablemax.com, Table Max News + Information, TableMAX, Inc., 2004, 1 page.

TCS John Huxley, "Protec 21 Blackjack Security"; 2005; 2 pages.

Digi Deal Corporation; Digital 21 "The Classic Game"; 2005; 1 page.

Mikohn Gaming Corporation; Tablelink Total View The New Standard in Table Games; 2005; 10 pages.

* cited by examiner

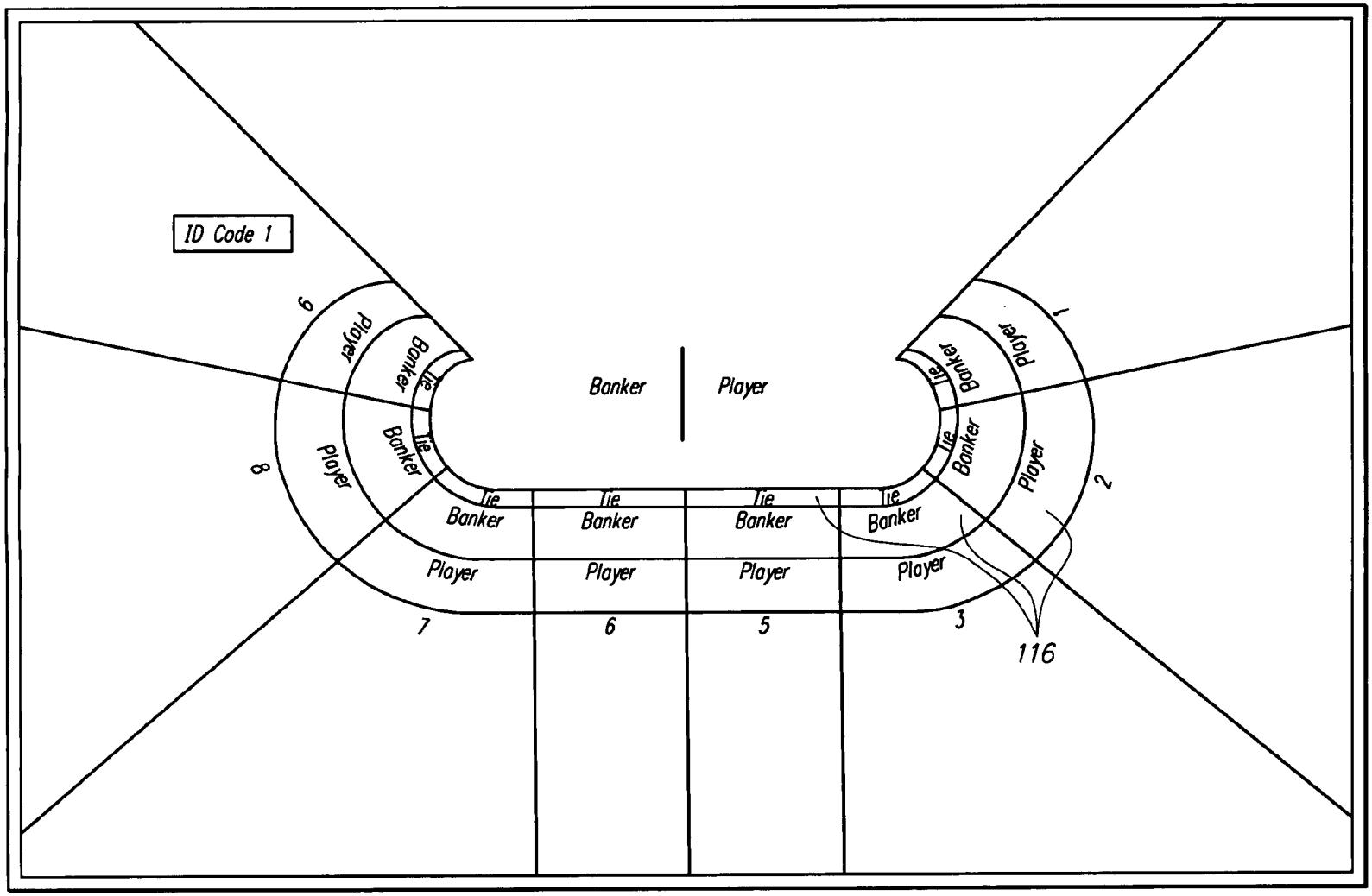
ID Code 1
Banker
Player
Tie
Banker
Tie
Banker
Tie
Banker

Felt ID 0045-2610-1961 Attributes:

| Game Attributes | |
|---|---|
| Type | Blackjack |
| Number of Seats | 6 |
| Number of Primary Wagers per seat | 1 |
| Number of Side Wagers per seat | 0 |
| Secondary Wagers per seat | 4 |
| Rule Set | A |
| Math Set | B |

| Ownership Attributes | |
|---|---|
| Type | Public Domain |
| Rights Ownership | NA |

| Image Attributes | |
|---|---|
| Datum Coordinates | |
| Right | 90,0,0 |
| Left | 0,0,0 |
| Primary Wager Coordinates x,y,z | |
| Position 1 | 70,16,0 |
| Position 2 | 60,22,0 |
| Position 3 | 50,25,0 |
| Position 4 | 38,25,0 |
| Position 5 | 28,22,0 |
| Position 6 | 18,16,0 |
| Side Wager Coordinates | |
| Position 1 | 71.5,13,0 |
| Position 2 | 62,19,0 |
| Position 3 | 53,24,0 |
| Position 4 | 41,24,0 |
| Position 5 | 30.5,21,0 |
| Position 6 | 21.5,15.5,0 |
| Secondary Wager Coordinates | |
| Position 1 | 70,16,0 |
| Position 2 | 60,22,0 |
| Position 3 | 50,25,0 |
| Position 4 | 38,25,0 |
| Position 5 | 28,22,0 |
| Position 6 | 18,16,0 |

| Regulatory Attributes | |
|---|---|
| Jurisdictional approval reference | ABC - 123 |
| | |
| | |
| | |
| | |
| | |
| | |

FIG. 15

Felt ID 0022-2011-1984 Attributes:

| Game Attributes | |
|---|---|
| Type | Specialty Poker |
| Number of Seats | 5 |
| Number of Primary Wagers per seat | 1 |
| Number of Side Wagers per seat | 1 |
| Secondary Wagers per seat | 1 |
| Rule Set | 123 |
| Math Set | 54 |

| Ownership Attributes | |
|---|---|
| Type | Proprietary |
| Rights Ownership | ABBC Gaming Co. |

| Image Attributes | |
|---|---|
| Datum Coordinates | |
| Right | 90,0,0 |
| Left | 0,0,0 |
| Primary Wager Coordinates X,Y,Z | |
| Position 1 | 70.5,17,0 |
| Position 2 | 58,24.5,0 |
| Position 3 | 43,26,0 |
| Position 4 | 27.5,23,0 |
| Position 5 | 16.5,15.5,0 |
| | |
| Side Wager Coordinates X,Y,Z | |
| Position 1 | 68.5,16.5,0 |
| Position 2 | 57,22.5,0 |
| Position 3 | 43,24,0 |
| Position 4 | 29,21.5,0 |
| Position 5 | 18.5,14.5,0 |
| | |
| Secondary Wager Coordinates X,Y,Z | |
| Position 1 | 71.5,15.5,0 |
| Position 2 | 60,23,0 |
| Position 3 | 45,26,0 |
| Position 4 | 29.5,24.5,0 |
| Position 5 | 17.5,17.5,0 |
| | |

| Regulatory Attributes | |
|---|---|
| Jurisdictional approval reference | ABC - 123 |
| | |
| | |
| | |
| | |
| | |
| | |

FIG. 17

TABLE MONITORING IDENTIFICATION SYSTEM, WAGER TAGGING AND FELT COORDINATE MAPPING

CROSS-REFERENCE TO RELATED APPLICATION

This application claims priority to U.S. Provisional Patent Application No. 60/881,407 filed on Jan. 19, 2007 titled TABLE MONITORING IDENTIFICATION SYSTEM, WAGER TAGGING AND FELT COORDINATE MAPPING.

BACKGROUND OF THE INVENTION

1. Field of the Invention

The invention relates to wagering game monitoring and in particular to a method and apparatus for monitoring a table and game play at table to track game play.

2. Related Art

Gambling has become a popular form of entertainment in the United States and in numerous foreign countries. Although numerous wagering events are offered within the casino or other gaming environment, one of the most traditional and popular forms of wagering occurs at table games. As is widely understood, traditional table games utilize a playing surface, often called a felt, upon which a dealer or other game operator offers a wagering event to one or more players or upon which a player may make a bet or wager.

As compared to slot or video type games, traditional table games offer greater excitement for some players, group play, and often attract big money players, which can result in larger profit margins for the casino. Slots or video type games, however, often integrate a player tracking system that allows a computerized system to monitor a player's participation, such as how often a player plays and how much a particular player wagers. Furthermore, electronic gaming machines, such as slot or video type machines accurately detect wagers and payouts and thus are very efficient at preventing cheating. In a table game environment however, it is often difficult to track how much money a player wagers and thus it is likewise difficult to accurately provide complimentary gifts or reward good customers to encourage a return to a particular property. Prior art systems use gaming tokens embedded with Radio Frequency Identification ("RFID") to track a player's betting for this purpose. An example of such a system is the Mikohn® Gaming Corporation's d/b/a Progressive Gaming International Corporation's Tablelink® product.

However, even with prior art bet tracking techniques, numerous wagering aspects may be missed or unmonitored. One drawback to prior art systems is that existing RFID type systems may not be able to accurately track every token, particularly when numerous tokens are stacked. In addition, prior art systems may suffer from inter-antenna interference if RFID antennas are spaced too closely together as such for games that have multiple and independent betting options per player seat, such as for example, the game of baccarat. As a result, table layouts require sufficient spacing between antenna, which in turn may prevent desired felt layout or prevent presentation of the desired game.

Another drawback of prior art table monitoring systems resulted when attempting to interface monitoring systems with a particular game. In prior art systems, the dealer or pit boss was forced to synchronize the monitoring system software with the particular game in play, and the particular version of the game in play. This step required additional training and time from busy casino personnel and failure to perform this step correctly will result in the tracking system providing faulty data that is not synchronized to game play.

Another drawback to the prior art is that while a RFID equipped token may be detected when placed on the table, once removed from the table, its status as a previous bet may be lost. In addition, payouts to a particular winning wager may not be associated with a winning wager, but simply detected as additional tokens being placed on the table. To adequately monitor game play, aspects of table monitoring beyond monitoring tokens placed on and removed from the table may be required.

The method and apparatus described below overcomes these drawbacks and provides additional benefits.

SUMMARY OF THE INVENTION

The table monitoring system generally comprises a camera configured to create a table image and image data, a RFID system configured to create RFID data, and a processing engine configured to process the image data and the RFID data to create one or more tags. In one or more embodiments, each tag represents at least one table event and has the image data and the RFID data associated therewith. The image data and RFID data may be associated to one or more tags in various ways. For example, the image data and RFID data may be associated based on a coordinate mapping (as discussed below), or based on the time of the table event which caused the image and/or RFID data to be created. As a table game is played, the processing engine may associate additional image data and RFID data created during play of the game to an already created tag. This allows a table event, over the course of a table game, to be monitored by its associated tag. A database may be included in the system to store the RFID data, the image data, or both if storage of such data is necessary.

In some embodiments, the table monitoring system may comprise one or more control parameters corresponding to each of the table games the monitoring system is designed to monitor. In these embodiments, the processing engine processes image data and RFID data according to the control parameters for the game presently being played. It is noted that in some embodiments, the system may include felt identification which allows the system to identify the felt currently being used on the table. In these embodiments, control parameters may be associated with the felt identification to allow the system to use control parameters suited for a particular felt.

The table monitoring system may also comprise a coordinate grid having one or more grid coordinates assigned to one or more relevant locations on the table. The image data and the RFID data may then by mapped to the coordinate grid to allow the system to determine where a table event has occurred. As stated, in one or more embodiments, the image data and RFID data may be assigned to one or more tags based on the coordinate mapping. In one or more embodiments, a biometric interface may be included to create player identification data and associate the identification data with one or more grid coordinates on the table. The processing engine, in one or more embodiments, may also be configured to cross-reference the RFID data and the image data based on the time and grid coordinates of the table events.

In one or more embodiments, the table monitoring system may include one or more peripherals such as but not limited to a card shoe, card shredder, chip tray, or the like. The peripherals may each have an identification code and one or more control parameters associated therewith. The processing engine may then be configured to identify and process table events related to these peripherals according to their individual identification codes and control parameters.

It is contemplated that some embodiments of the table monitoring system will not include a camera and may instead rely on the RFID system to tag and monitor table events. However, embodiments having a camera may utilize image data created by the camera to better monitor table events. For example, the system may comprise a plurality of bet locations within the detection zone of a single RFID antenna. RFID alone may not allow table events, such as wagers placed certain these bet locations, to be distinguished. Therefore, the system or an image controller in the system may be configured to identify the one or more table events such as but not limited to placing of bets in any of the bet locations. The processing engine may now be configured to distinguish the table events occurring in any of the bet locations by cross-referencing the image data created by the image controller with the RFID data from the RFID system.

The image controller in one or more embodiments creates image data by analyzing the table images created by the camera and identifying bet locations for and table events of each table game that is being monitored. Notably, a separate image controller is not required in every embodiment because other elements of the monitoring system, such as the camera, may perform the function of the image controller.

The method of monitoring one or more table games is an electronic method of monitoring. In one or more embodiments, the method comprises creating RFID data in response to one or more table events detected by one or more RFID antennas, each of the RFID antennas having a detection zone, and creating image data by analyzing a plurality of table images. Once this data is created the RFID data and the image data may be cross-referenced and mapped to a coordinate grid. One or more tags representing at least one of the table events and having RFID data, image data, or both associated therewith may then be created. As the table game is played any additional RFID data, image data, or both may be associated with at least one of the earlier created tags.

The method of table game monitoring may include identifying one or more players and associated at least one relevant location on the coordinate grid to the identified player. This is used to allow the wagers of a particular player to be monitored. In addition, the method may include identifying at least one felt identification associated with at least one of the table games to be monitored. Once a felt has been identified, the RFID data, image data, or both may be associated to one or more tags according to the felt identification's corresponding control parameters.

Some table games may have multiple bet locations within the detection zone of a single RFID antenna. Accordingly, some embodiments of the method of electronic table game monitoring may include distinguishing each table event occurring within the detection zone of a particular RFID antenna by cross-referencing the RFID data and the image data. Finally, some embodiments of the method may include the step of storing the RFID data, image data, or both in a database.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

FIG. 8 illustrates an overhead view of another example table felt layout.

FIG. 15 illustrates a sample spreadsheet outlining example felt coordinates that define locations of various aspects of the felt and items on the felt.

FIG. 17 illustrates a sample spreadsheet of control parameters including the wagers placed.

DETAILED DESCRIPTION

Figure 1:
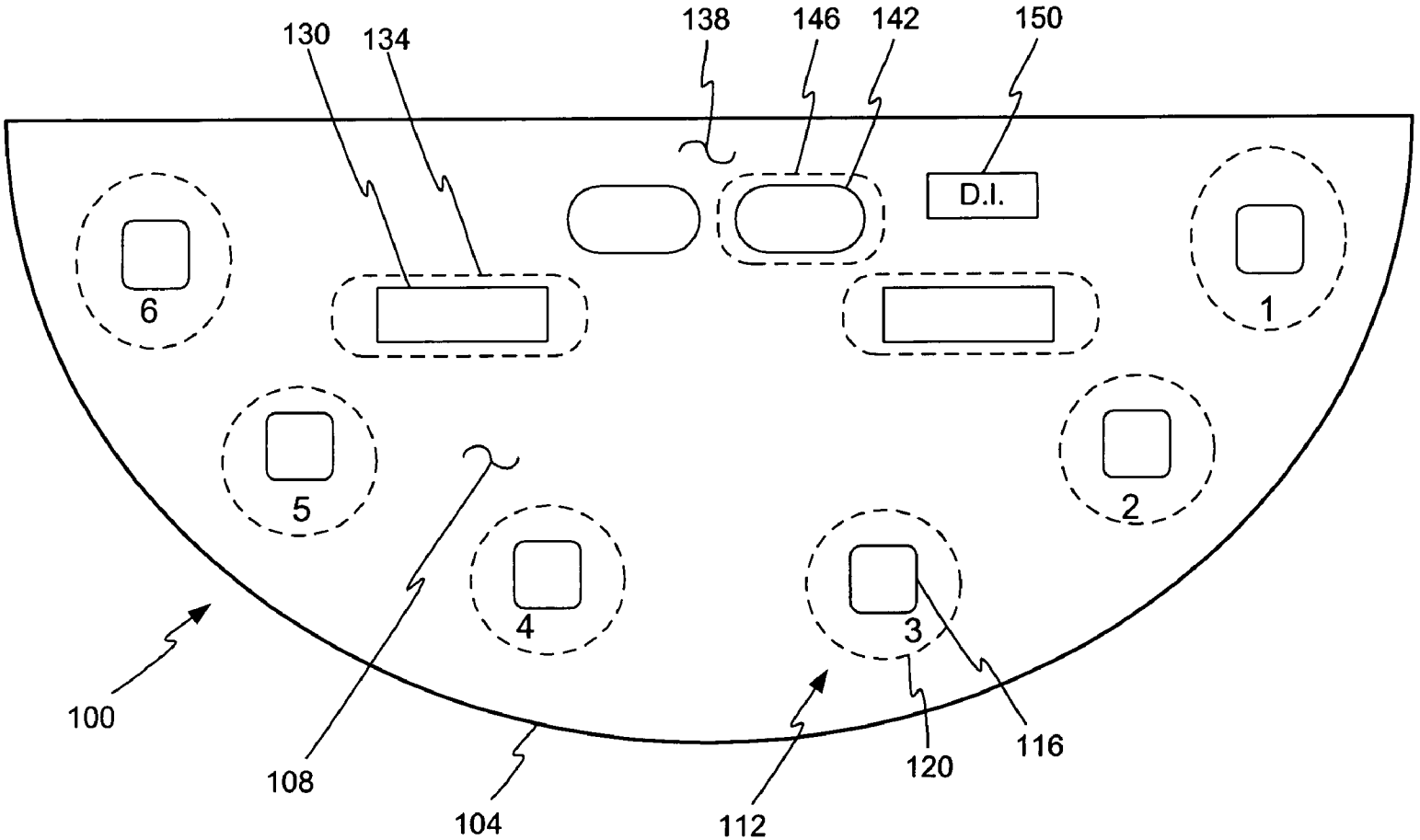
FIG. 1 illustrates a top plan view of an example embodiment of a gaming table for use with a table game.

FIG. 1 illustrates a top plan view of an example embodiment of a gaming table for use with a table game. This is but one possible table arrangement and layout and it is contemplated that one of ordinary skill in the art may arrive at other table arrangements to promote game play or accommodate a greater or fewer number of players. For example, it is contemplated that the method and apparatus described herein may be utilized with any game layout. Likewise, the table can be configured in a stand-up or sit down arrangement. In this example embodiment the table 100 includes an outer edge 104 surrounding a generally flat top surface 108. The table may also be configured to accommodate other types of traditional table games including, but not limited to, dice games such as a modified form of craps, poker, baccarat, or proprietary table games such as roulette, craps, and other games which use dice, wheels, or cards or any combination of dice, wheels, or cards. Table games include games of chance that use cards or dice, and tokens, such as chips of differing values. Traditional table games also include proprietary games such as Caribbean Stud Poker® which include a progressive jackpot. Other proprietary traditional table games include games such as Three Card Poker®, Royal Match 21® and Texas Hold'em Bonus™. Proprietary table games are table games for which a casino will lease or purchase from a manufacturer because the proprietary traditional table game is protected by the intellectual property of the manufacturer. The term "traditional table game" is used to distinguish from products offered by TableMAX® and Digideal's Digital 21™ which use video representations of cards. There are other non-traditional table games that have digital roulette wheels with video or digital images of dealers.

In this example embodiment of a table, configured for use with the game of blackjack, there is an outer edge 104 of the table 100. One or more player stations 112 are provided and configured for use by a player to participate in a waging game or a game of chance offered at the table such as blackjack. In this embodiment the player stations 112 comprise a bet spot 116 wherein a player may place one or more wagers during the course of play. For example, the player may place the chips or tokens within area 116 when placing a bet during the course of play. Overlapping the bet spot 116 is a detection zone 120. The detection zone 120 comprises a zone within which a bet detection system, described below, may detect the token, such as an amount bet by a player at a player location 112 or player station at the table 100. Likewise, the simple presence of a bet may also be detected by the bet detection system or other data stored on the token.

In other various embodiments, one or more supplemental bet spots 130 may be located in one or more other locations on the table surface 108. By way of example, a supplemental bet spot 130 may be located as shown and shared by more than one player. A supplemental detection zone 134 may likewise be associated with the supplemental bet spot 130 to detect a bet therein. The supplement bet spots 130 may comprise coin buy spots with associated detection. A supplemental detection zone 134 could also be added to detect multiple bets that are required or optional by a player in proprietary table games such as Caribbean Stud Poker®, Three Card Poker®, Royal Match 21®, Texas Hold'em Bonus™, and Two Card Joker Poker™.

In this example embodiment a dealer position 138 is located generally opposite one or more of the player positions. As is generally understood, the dealer presents the game from the dealer station 138. Associated with the dealer station 138 are one or more dealer spots 142 which in turn may be associated with one or more dealer detection zones. The dealer spot 142 is a location on or in some way associated with the table and/or the dealer on which tokens may be placed for detection by the detection system. As used herein, the term token often references a detectable identification type token. The dealer detection zone 146 is the area in which the detection system can detect tokens placed in the dealer spot 142. This dealer detection zone 146 could be used in player banked traditional table games such as those played in the State of California or other jurisdictions. The dealer detection zone 146 may also be used to hold ante bets contributed by players in Class II gaming jurisdictions such as Native American gaming establishments in the State of Florida.

A dealer interface 150 may also be place near the dealer position 138. The dealer interface 150 comprises a user interface configured to allow the dealer to provide input to the detection system and optionally receive input from the detection system. In various embodiments, the dealer interface 150 comprises one or more buttons, dials, display screens, lights or other illumination devices, speakers or other audible indicators, or analog dials, potentiometers, or keypads. Through use of the dealer interface 150, the dealer is able to provide input to the detection system or receive data from the detection system.

Figure 2:
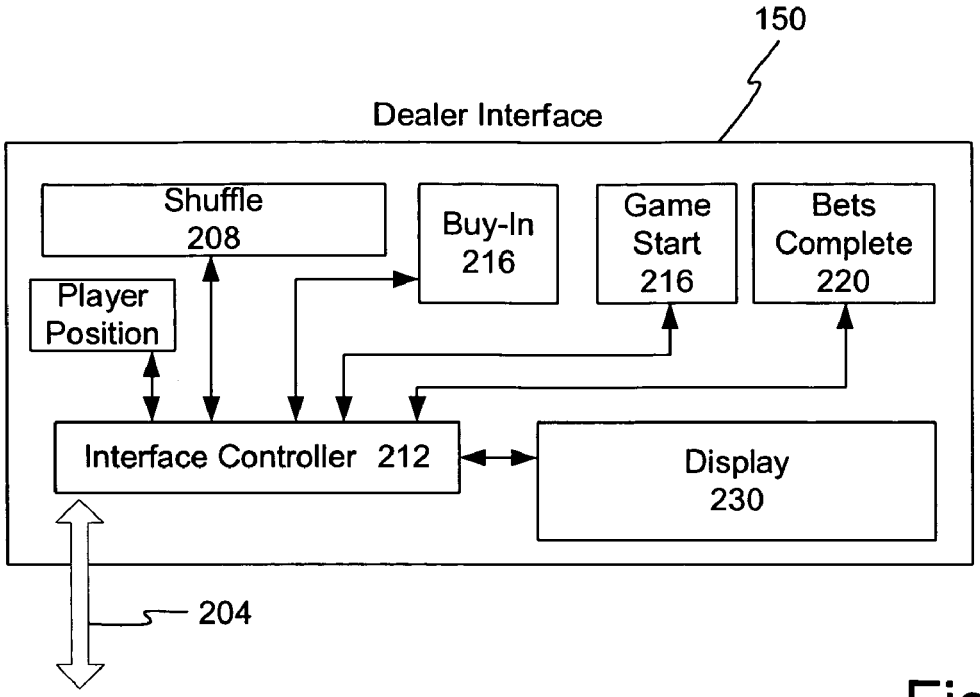
FIG. 2 illustrates a block diagram of an example embodiment of the dealer interface.

FIG. 2 illustrates a block diagram of an example embodiment of the dealer interface, such as dealer interface 150, shown in FIG. 1. This is but one possible example embodiment and it is contemplated that other embodiments may be created which utilize additional or fewer components and modes of operation. As shown, a dealer interface 150 comprises an input/output port 204 that connects to an interface 212. The interface controller 212 is configured to control input and output from the dealer interface 150 to the detection system. The interface controller 212 may comprise any device or element configured to perform as described herein. Connecting to the interface controller 212 is a shuffle indicator button 208, a game start button 216, a bets placed button 220 and a one or more other optional buttons or inputs which may be configured as desired. A display 230 may also be provided to provide information, alerts, or data to the dealer. A speaker or other audio device (not shown) may also be provided.

The shuffle indicator button 208 comprises a dealer input device or indicator that the dealer may utilize to provide an input to the detection system that a shuffle has just occurred or is about to occur. Another shuffle indicator may come from an attached card shuffler mechanism. Either method provides data to the system to signal when dealing from a newly shuffled shoe is about to occur. The game start button 216 comprises an indicator that the dealer may utilize to provide an input to the detection system that a new game is about to begin. As used herein, a game start is defined as a dealing of a round of cards or other indicia to the players. In other games, other events may define the start of a new game. It is contemplated that multiple games may occur between shuffles of the deck.

Of course, in embodiments which utilize indicia other than cards, such as games that utilize dice or wheels, other buttons with different labels may be utilized to achieve the method and apparatus as described herein. It is also contemplated that the dealer interface 150 may include a key board and/or a display to thereby provide means for the dealer to input player information and player position. The dealer interface 150 may also be equipped with player tracking interface to accept and read player tracking cards and to be able to receive number or letter codes for a player. The player tracking interface will lock in a name or code to identify each player using a player location 112. The player tracking interface can be operated by the dealer or pit supervisory personnel to provide this Play Lock-In Data.

The bets complete button 220 may be utilized when all the bets for a particular round of play have been placed and hence, any additional bets or changes to the bet pattern may be in violation of the game rules. It is further contemplated that a button may also be included on the interface 150 to indicate that bets are being allowed or accepted. This may also be used during a payout or bet collection period.

The display 230 may comprise any type of display capable of providing information to the dealer or other casino personnel. Any type of information may be provided. In one embodiment alerts regarding detected events may be shown on the display, such as but not limited to, players changing their bets or bets being placed at the incorrect time.

Figure 3:
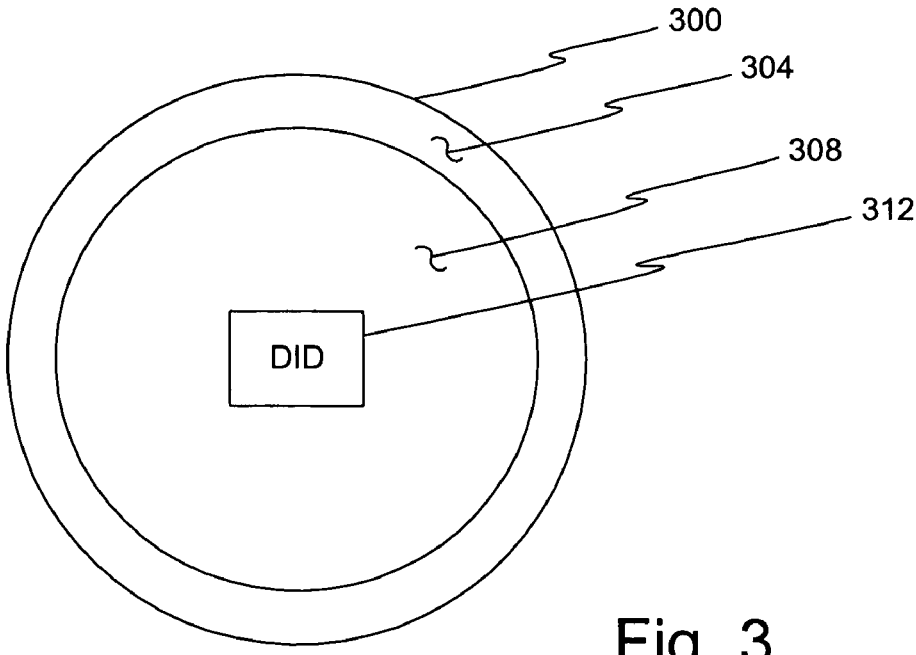
FIG. 3 illustrates a top plan view of a token equipped with detectable identification.

FIG. 3 illustrates a top plan view of a token equipped with detectable identification (hereinafter DID). The term DID is defined to mean any technology that may be associated with the token or in any way imbedded within the token to allow for detection of the token using sensing technology. One example of DID technology is radio frequency identification (RFID) technology wherein a sensor is imbedded within a token and the sensor may be activated or powered using an antenna and/or energy emitting device thereby causing the DID to emit data. RFID tokens are available from Gaming Partners International, located in Las Vegas, Nev.

As shown in FIG. 3, a token 300 comprises an outer surface and edge often formed in a coin shape. An outer rim 304 may be provided with markings and to provide support to the structure of the token 300. Inside the area defined by the outer ring 304 is a middle area 308 of the token 300. The middle area, or other area of the token, includes a DID element 312 that may be configured to identify any type of information associated with the token. The information stored or associated with the DID may comprise the value assigned to the token, an identification code or serial number (which is typically unique), player information, a client or casino name, secret data, encryption information or codes, public information, physical chip size, data regarding memory, creation or in use date, DID type or family, or a combination thereof.

In one example embodiment the token 300 and DID technology 312 comprise a microchip having read and write memory, such as for example 256 bits, with one or more configurable sections to meet the particular application. Data may be entered into the DID device and sealed or encrypted to prevent fraud or tampering. In one embodiment, at least some of the data stored within the DID device may be changed or updated by a casino or when provided to a player.

Figure 4:
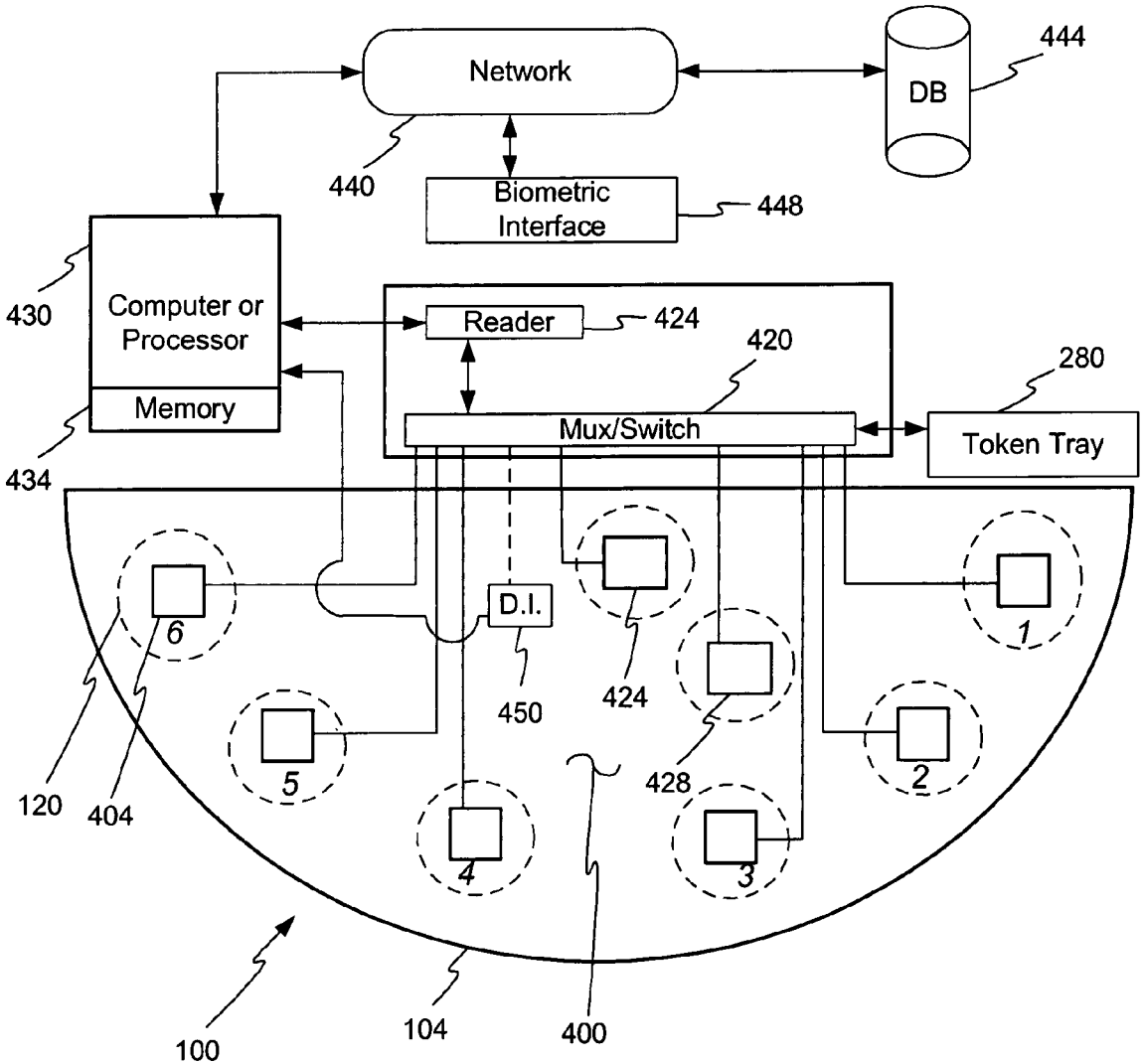
FIG. 4 illustrates a block diagram of the detection system in connection with a game table.

FIG. 4 illustrates a block diagram of the detection system in connection with a game table. This is but one possible example configuration and the elements as shown are for purposes of discussion and hence are not to scale. As part of the table 100, there is an underside 400 of the table, which is shown in FIG. 4. By way of reference, the outer surface 104 and player positions 1-6 are shown. A DID antenna 404 may be mounted below the table 100, be integral with the table, or on the top of the table. In this embodiment the DID antenna 404 is below or on the underside 400 of the table and creates a detection zone 120 when so instructed by the detection system describe above. The detection zone 120 may also be understood as the area in which the energy emitted by the antenna energizes the DID detectable identification of the token.

The DID antenna 404 connects to a multiplexer or switch 420, which in this embodiment controls communication between a reader 424 and the antenna 404. It is contemplated that communication between the reader 424 and the one or more antenna 404 is bi-directional such that the reader may provide an electrical excitation signal to the antenna 404. The antenna 404 converts the electrical signal to an electro-magnetic field (EMF), which excites or powers the DID aspects of the token located within the detection zone. As a result and in response to the excitation EMF signal, the antenna may also detect data emitted from the DID device. The data is sent back, via the multiplexer 420, to the reader 424.

A token tray 280 may also be provided that reads and/or writes incoming and/or outgoing tokens. This provides the monitoring system with data regarding the tokens purchased by players and tokens collected by players. This allows the system to further track incoming and outgoing tokens. Tokens purchased by a player and not passing through the token tray 280, i.e. won or cashed in, may be assumed to have left with or been kept by the player. Tokens presented for play on the table that do not pass through the token tray 280 may be assumed to have been brought to the table by the player.

Operation of the other DID antenna associated with the other player stations occurs as described above. A dealer DID antenna 424 is also provided with the associated detection zone. One or more secondary bet or token spot antennas 428 with associated detection zones are also provided as shown. These elements 424, 428 also connect to the multiplexer/switch 420. Hence, the reader 424 may selectively read the DID information contained within the tokens placed at the bet spots as shown in FIG. 1 during the course of game play. A device other than a multiplexer may be used to concurrently energize more than one antenna to speed the read process. A dealer interface 450 also connects to a monitoring system, such as to a computer 430, or via the multiplexer 420 to thereby provide input to the computer 430, such as shuffle and new game data, place bets data, no bets accepted data, or any other indication signals. The detection system on the computer 430 may also detect if bets are made or changed at times that are not allowed.

The reader 424 connects to any type processor which may be embodied in a computer 430 having memory 434. The computer is configured to execute machine readable code which may be stored on the memory 434. The machine readable code may comprise software code or code logic capable of interaction with other systems, such as the reader. Software code may be referred to herein as machine readable code. The computer 430 may include an input interface for receiving input from a user such as pit supervisory personnel or dealer, such as a keyboard, analog dial, potentiometer, mouse, touch screen, or any other device capable of providing information to the computer. The computer 430 may also be configured with one or more displays. The computer 430 will allow the input of information by pit supervisory personnel and/or a dealer.

In the embodiment shown in FIG. 4, the computer 430 connects to a network 440 which in turn may connect to a database 444 and/or a biometric interface 448. A database 444 is generally understood in the art as an accessible memory for storing accessible data. For example, the database may be used to store token data, game data, control parameters, RFID data, image data, grid coordinates, felt identification, and other data required or used by the monitoring system as discussed herein. The network 440 may include access by surveillance personnel in the casino.

The biometric interface 448 comprises any type system configured to monitor and identify players based on one or more player characteristics. In one such configuration a camera is capable of capturing a player's picture, such as of their face, and the biometric system compares the player's picture to a data base of known dishonest players or banned individuals. In another configuration the biometric system is capable of identifying a player through vein recognition such as by capturing a representation of a player's vascular system by an infrared camera. The biometric system 448 in connection with the bet detection system may be utilized to monitor for and identify certain players who may be attempting to gain an unfair advantage. One exemplary biometric system is available from Biometrica Systems, Inc in Las Vegas, Nev.

It is also contemplated that the computer 430 and the network 440 may be equipped to send and receive e-mail or other forms of electronic output. In one embodiment, the detection system, such as the computer 430, the network 440, or a mail server associated with the network, may be controlled to send e-mail, voice messages, or other notification to a party to alert or notify them of information generated by the detection system.

Figure 5:
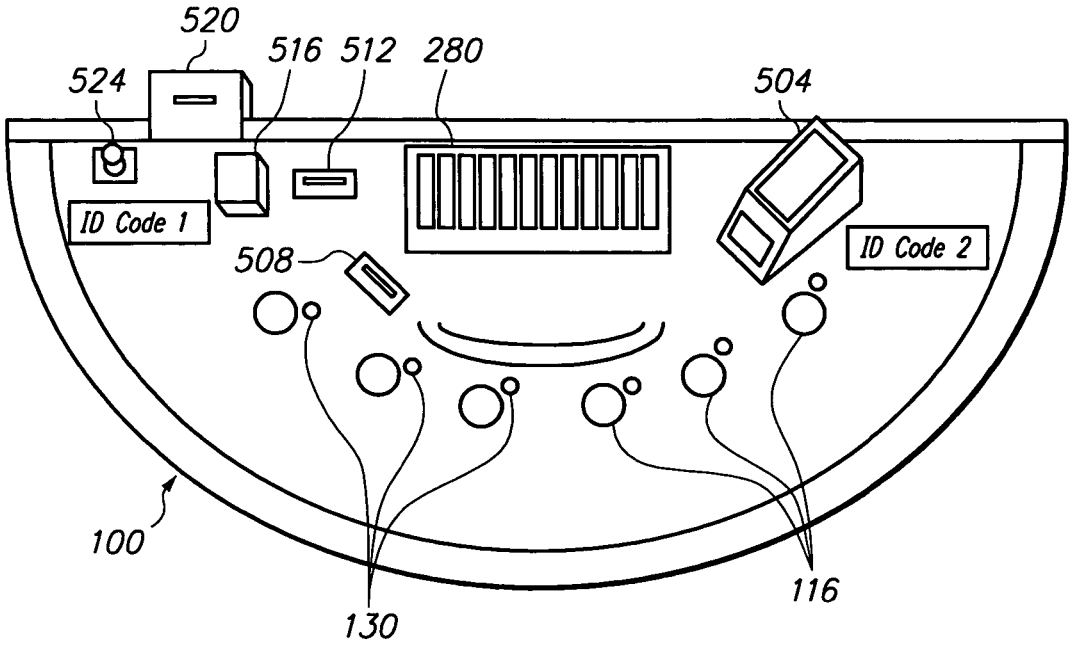
FIG. 5 illustrates a perspective view of a blackjack style D shape table.

FIG. 5 illustrates a perspective view of a blackjack style D shape table with table components. This figure illustrates the various components on or associated with the gaming table. Some or all of these elements may interface with or connect to the table monitoring system to thereby provide data to and are part of the table monitoring system.

As used herein the term table monitoring system is defined to mean the entire system that monitors play on the table. At a high level, this may comprise one or more of the following, a RFID system, an overhead or table mounted camera, and/or a dealer interface. Also part of the table monitoring system are one or more peripheral devices such as those elements shown in FIG. 5. Operating on a processor, which may be contained in any suitable environment, such as a computer, network, or dedicated system, is an engine. In this embodiment the engine comprises software executing on one or more processors. The engine receives all the input from the various components of the table monitoring system and processes these inputs to generate the desired outputs. Associated game and/or table data may be stored in memory and is accessible by the engine. The game and/or table data may be associated with a particular game, game version, and/or table layout.

As can be appreciated, the engine must know how to interpret the incoming data from the various table monitoring components. One aspect that is used to interpret the data is for the engine to 'know' the game in play and the table layout. And for an engine to properly process the data, the engine preferably is able to properly interpret the data based on known information about the game in play, the table layout, and location of RFID antennas and which bet locations those antennas correspond to, the type of data provided from each peripheral, the required rules and procedures of the game, the required method of play for the players and the dealers, and any other aspect of the table monitoring system and game.

As shown in FIG. 5 and other various figures herein, the table 100 may be labeled with a table identification, shown in FIG. 5 as ID Code 1 and ID Code 2. These one or more table identifications may be read or detected by the table monitoring system. The reading or detecting may comprise having a dealer, pit boss, or other personal manually, read by a camera and processed to yield data, detected by an RFID system, or scanned or detected in any other way. One or more codes, in this embodiment two codes are used to provided different levels of resolution or duplicate codes. One code may represent the table game, while another may represent the table rules. In one embodiment the codes may be the same so that at least one code is always visible and not blocked by a player or dealer or peripheral.

The table identification provides a code or identification to the table monitoring system which may be used to retrieve a pre-stored set of control parameters which are used to interpret and/or process data received by the engine from the other components of the table monitoring system. Upon receiving this code, the proper control parameters may be retrieved from memory and used by the engine to properly interpret and process the incoming data.

As way of example, and not limitation, FIG. 5 illustrates an exemplary blackjack table layout including betting locations in the form of bet spots 116 and supplemental bet spots 130. Upon reading the table identification and utilizing the corresponding control parameters, the table monitoring system, and in particular the engine, is aware of the betting locations and the size of each betting location, and which player position is associated with each betting location. In addition, the dealer and player cards area may be defined. Areas where tokens and cards are not allowed may also be defined. The control parameters may define the rules of play, which will allow the engine to detect improper patterns of play, mistakes, and cheating. In addition, the pay tables and payout rates may change several times during the course of the day. Thus, although the table may look the same, and the same game is played, the pay table may change. Changes in the pay table will affect game play and monitoring, such as for example payout rates.

The control parameters may also define the data received from the table's peripherals. As shown in the embodiment of FIG. 5, such peripherals may include a tip box 520, drop box slot 512, card shredder 508, chip tray 280, and electronic card shoe 504. Additional peripherals and various combinations of peripherals are contemplated as well. Thus, in one or more embodiments, the table's peripherals may include a dealer interface, RFID system, and camera system, or any other peripheral.

The control parameters may also be different for different versions of a particular peripheral. For example, different electronic card shoes may be in use and as such, different shoes, or different versions of the same shoe may have different data output characteristics, which should be known by the engine so that data from the peripherals may be properly interpreted and utilized.

As a result of providing a table identification on the table and associating control parameters with the table identification, the process of configuring the table monitoring system to properly function with the table and game played thereon is greatly reduced. If manually entered, the code is present on the table for easy reading and entry. If automatically read, the system may be fully automated, that is, upon use of the table, the table identification is read and processed by the system. Errors may be reduced, as the code is on the table, or in the case of an automated procedure, the process occurs automatically, thereby eliminating errors or failure to enter new table identification when a table or game is changed. An automated read process, as described below, is particularly helpful considering that tables or game rules may be switched multiple times per day.

Figure 6:
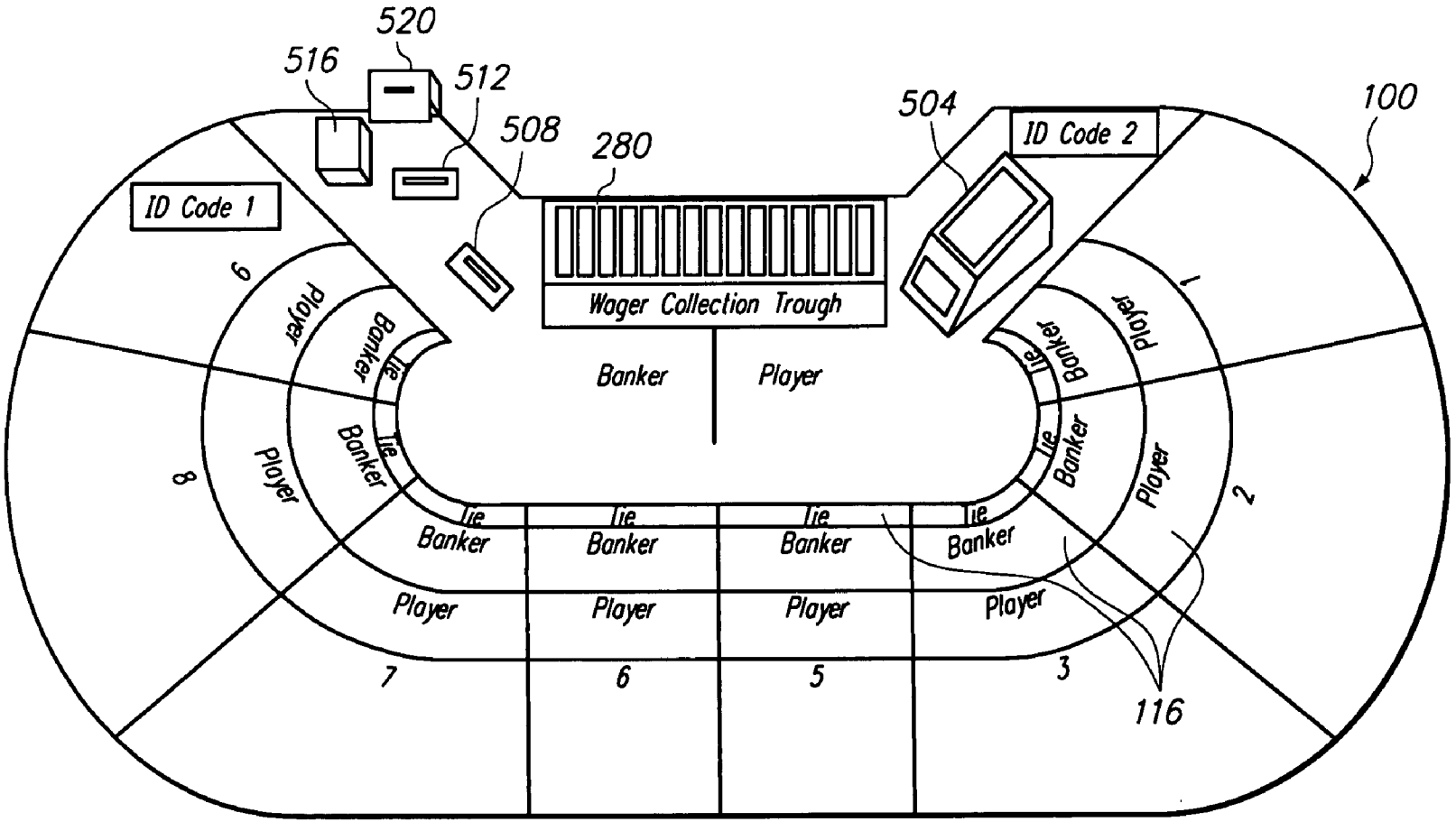
FIG. 6 illustrates a typical eight position MIDI baccarat table layout.

FIG. 6 illustrates a typical eight position MIDI baccarat table layout with associated components. As compared to FIG. 5, FIG. 6 illustrates a significantly different table layout for a different game. As can be appreciated, the table layout and game rules for a game played on table of FIG. 6 is different then a game played on the table of FIG. 5. By coding the table with table identification, the particular proper control parameters may be associated with the table identification for the particular table and game to rapidly and accurately configured to table monitoring system for use with the particular table/game in play.

Figure 7:
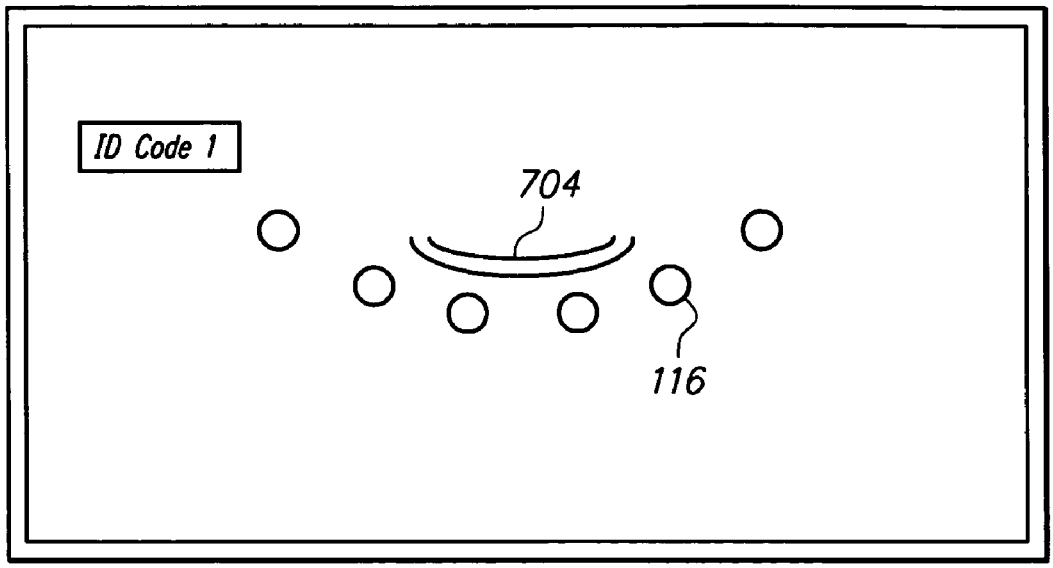
FIG. 7 illustrates an overhead view of an example table felt layout.

FIGS. 7 and 8 illustrate overhead views of table felt layouts of FIGS. 5 and 6 respectively, showing only the betting areas or bet spots 116 and felt markings 704. Using the table identification (ID Code 1) for each table, which is contemplated as being different, the monitoring system may be automatically configured to function with the particular table and game played thereon.

Figure 9A:
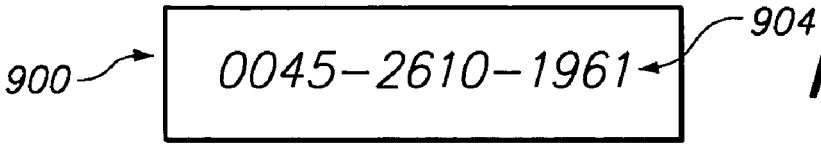
FIGS. 9A-9D illustrate examples of different table identification.
Figure 9B:
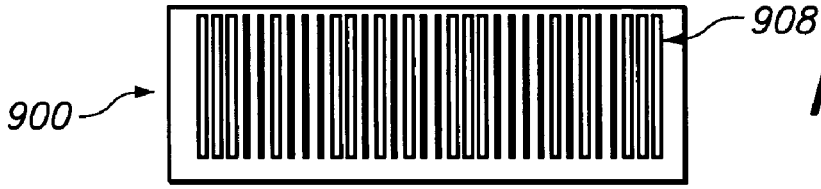
Figure 9C:
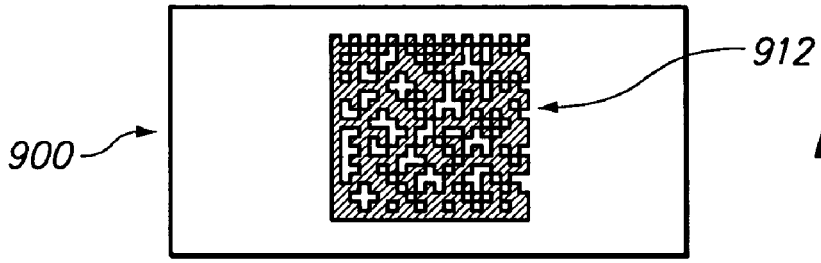
Figure 9D:
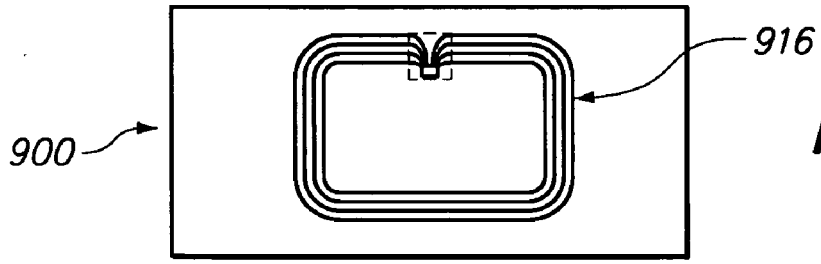

FIGS. 9A-9D illustrate examples of different types of table identification formats. The table identification 900 may comprise an alpha numeric code 904 as shown in FIG. 9A. The table identification 900 may comprise a one dimensional bar code 908 as shown in FIG. 9B. The table identification 900 may comprise a two dimensional bar or dot code 912 as shown in FIG. 9C. The table identification 900 may comprise a RFID enabled tag 916 to be read by a RFID reader as shown in FIG. 9D. Any type of table identification 900 may be used in addition to those described here including random designs or patterns which do not appear as codes to the human eye, or other codes which are not visible to the human eye. It is contemplated that one or more forms of table identification 900 may appear on a table. In addition, it is contemplated that each element of the table monitoring system may be issued an identification code. For example, the shuffler, the dealer interface, and the chip tray may each be issued unique identification numbers. Use of the peripheral numbers may be the same as describe above for the table identification. It is also contemplated that cards may be issued identification numbers, such as the back of each card may contain a machine detectable code to verify which playing cards are in play and that unauthorized cards are not in use. The dealer may also be issued a dealer code, in the form of a badge or other identification, which may be entered into the table monitoring system or placed on the gaming table for reading by the table monitoring system.

Figure 10:
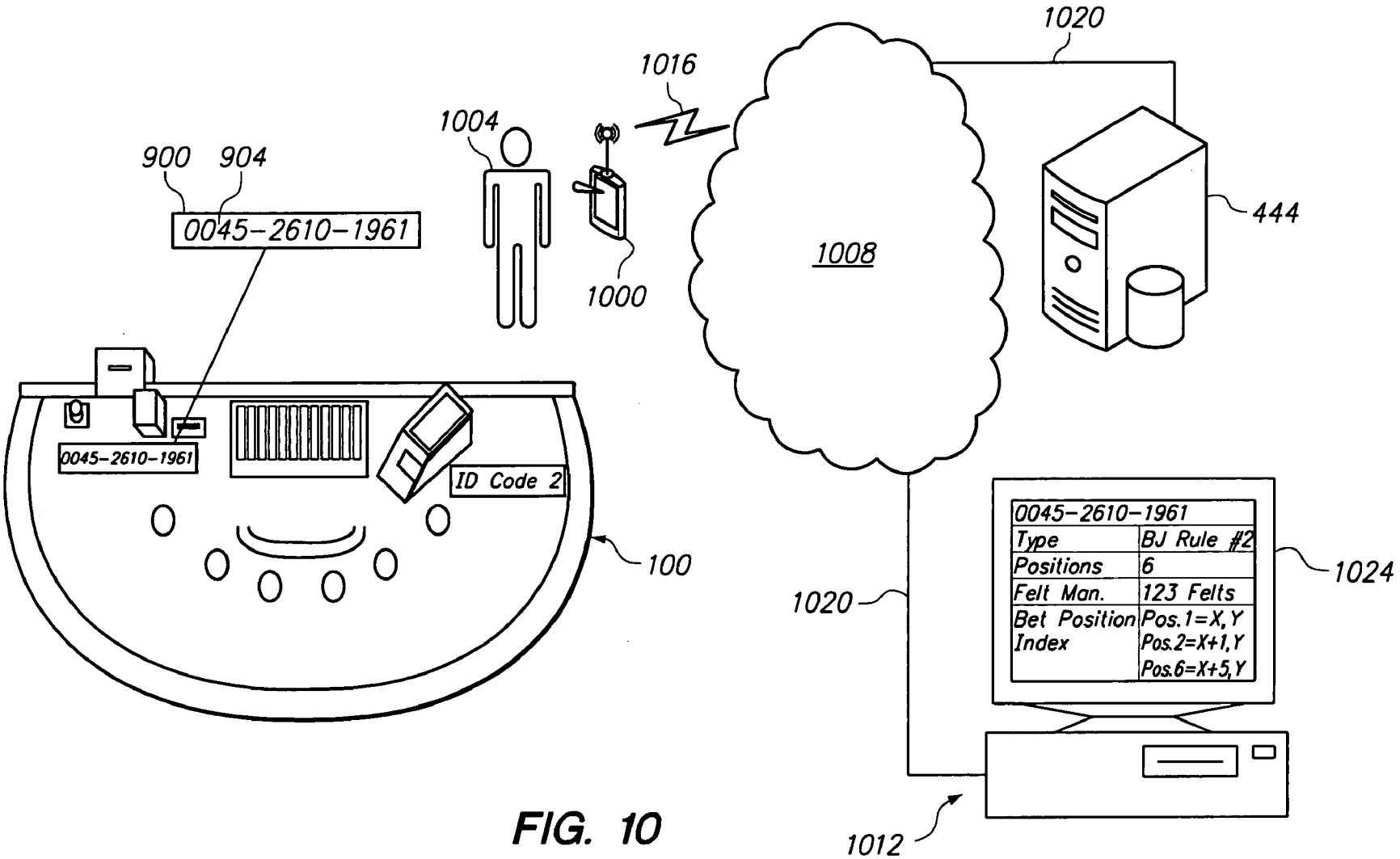
FIG. 10 illustrates a block diagram of a table monitoring system with a wireless interface.

FIG. 10 illustrates block diagram of a table monitoring system with a wireless interface. In this embodiment a dealer, pit boss, or other personnel 1004 manually enters the table identification 900 comprising an alpha numeric code 904 using a wireless communication device 1000. Any type wireless device may be used. The data is conveyed back to a database 444 and workstation 1012 for use by the engine. The data may be conveyed in various ways such as but not limited to via a network 1008, one or more wired 1020 or wireless 1016 connections, or a combination thereof.

Figure 11:
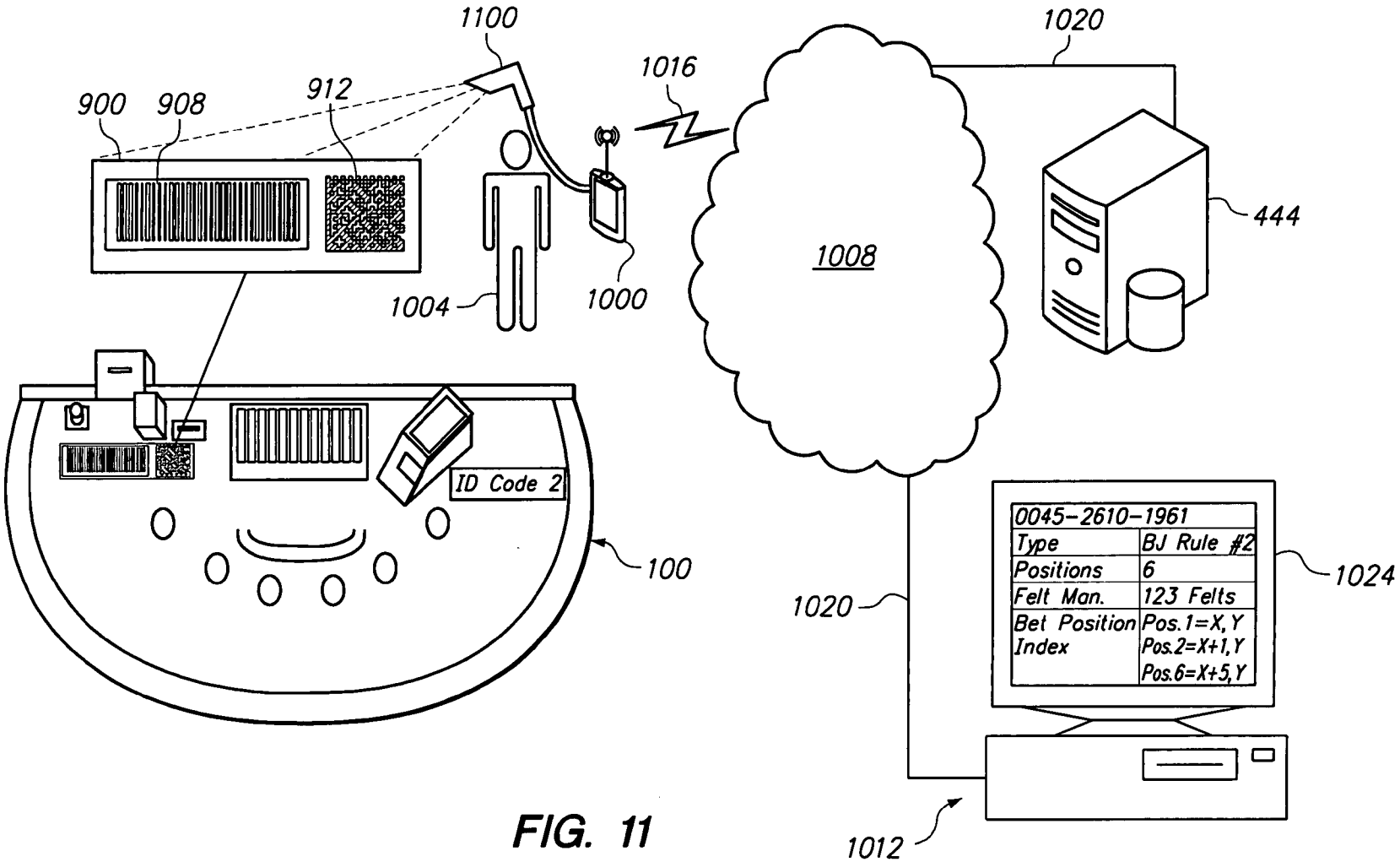
FIG. 11 illustrates a block diagram of a table monitoring system with a scanner.

FIG. 11 illustrates a block diagram of a table monitoring system with a scanner 1100. In this system, the user or other personnel 1004 would scan the table identification 900. Any type identification can be scanned.

Figure 12:
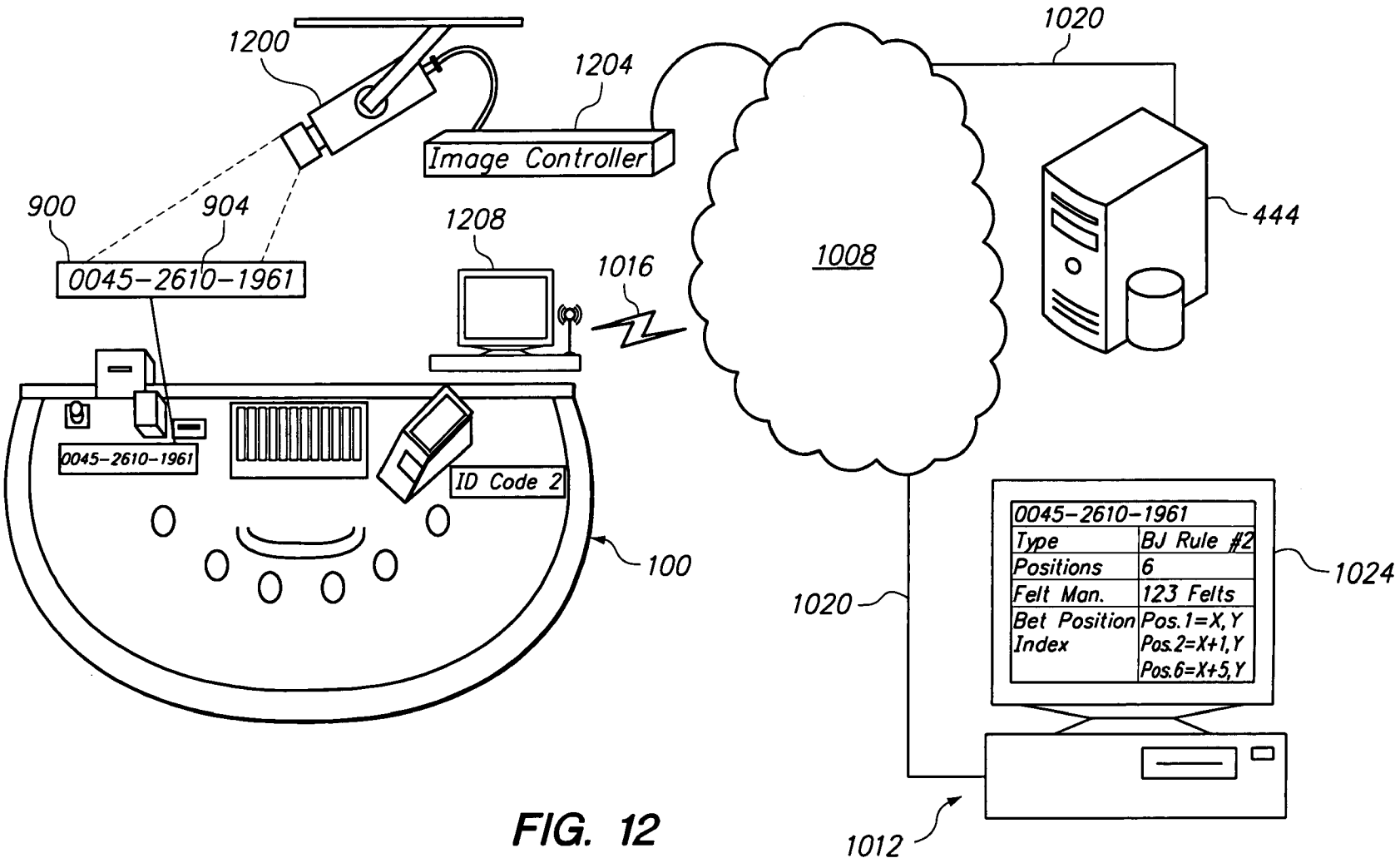
FIG. 12 illustrates a block diagram of a table monitoring system with an overhead or table mounted camera.

With regard to FIG. 12, a system is shown with an overhead or table mounted camera 1200 configured to read the table identification 900, or any other identification on the table. The camera system may also monitor game play on the table 100. In this system, the camera 1200 connects to an image controller 1204 configured to process the image data to generate a non-graphical representation of the table identification 900, such as digital data representing the table identification in numeric form.

Figure 13:
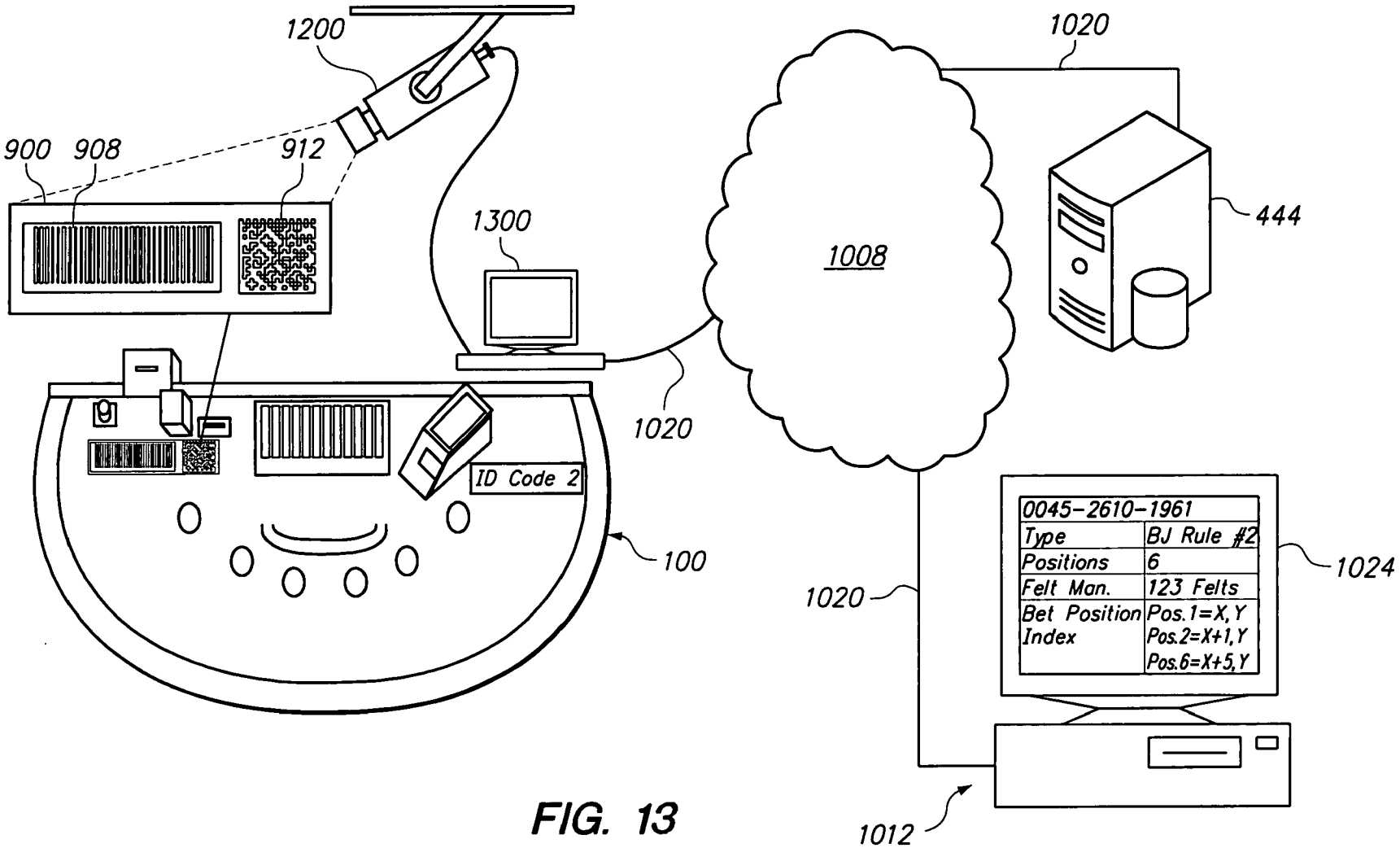
FIG. 13 illustrates a block diagram of a table monitoring system with a computer configured as a table controller or image controller.

FIG. 13 is similar to FIG. 12, but the camera 1200 connects to a computer configured as a table controller or image controller 1300 which may be optionally located at the table 100. The alpha numeric code 904 comprising the table identification 900 may be replaced with bar code 908, 912.

Also shown on FIGS. 10-13 is a computer or workstation 1012 having a monitor 1024. On the monitor 1024 is a display of an example of a portion of the control parameters associated with a table identification code. Shown on the monitor 1024 of FIG. 13, is the table identification, the type of game with game identifiers, shown here as blackjack with rule set #2. As is understood, the base game of blackjack may have numerous different rule sets, which modify how the game is played, payout rates, or other variations. The next data field identifies the number of player positions, and the felt manufacturer or some other felt identification. Also shown as part of the control parameters are felt layout codes.

Figure 14:
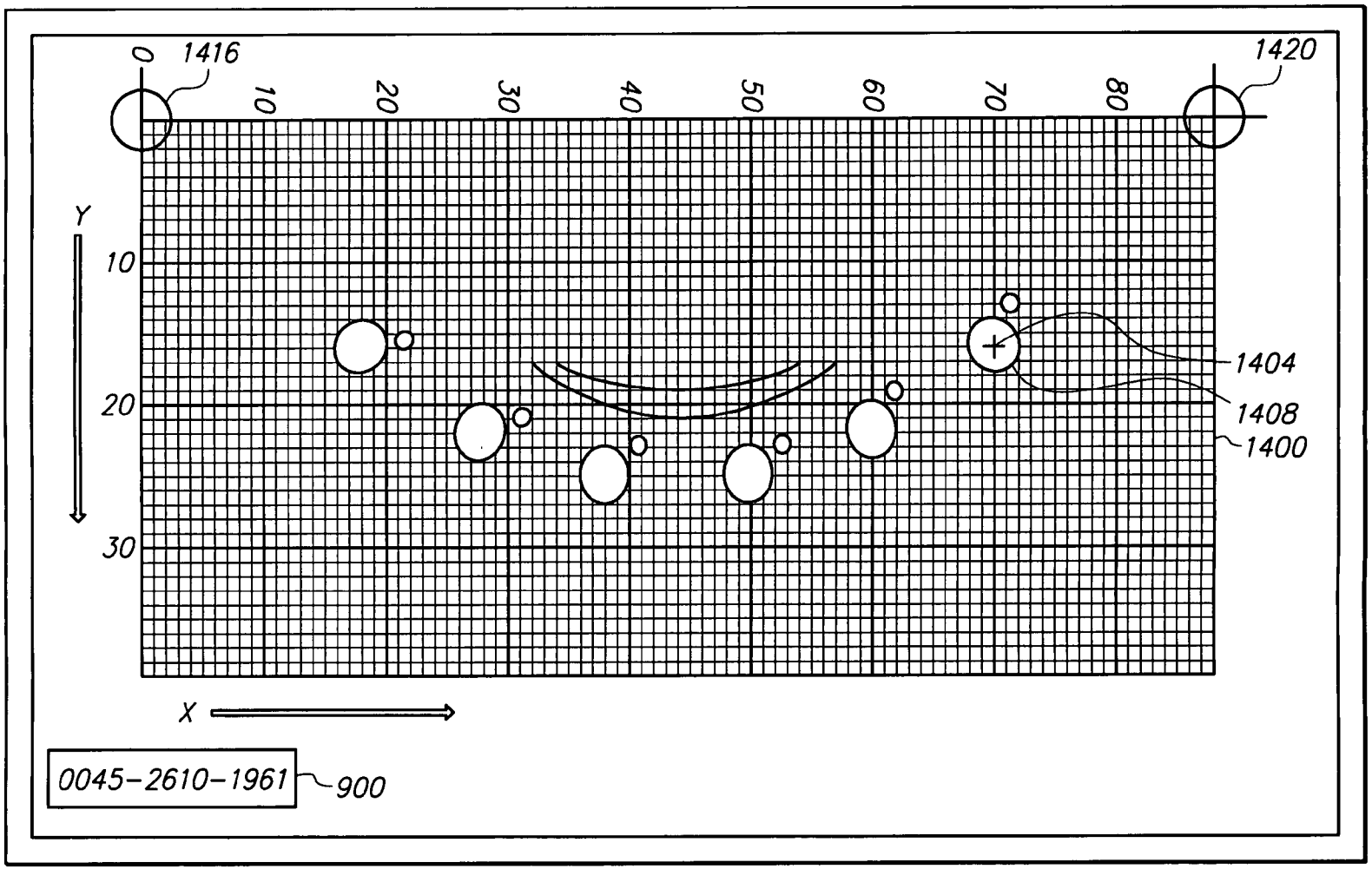
FIG. 14 illustrates an example coordinate grid overlaid on a sample felt.

Felt layout codes are better understood based on FIG. 14. FIG. 14 illustrates an example plot overlaid on a sample felt, such as that shown in FIG. 5. Using this plot or grid coordinate overlay 1400 or any other plot system, a position or an area on the felt may be identified by grid location(s) which are felt coordinates. In one or more embodiments, the plot system may include a left datum 1416 and a right datum 1420 as reference points to align the plot system to the felt. In addition, in one or more embodiments, the table identification 900 may be used to identify the felt currently in use.

In the embodiment of FIG. 14, the horizontal axis and vertical axis is labeled in incrementing numbers. By providing an X and Y axis coordinate, a location on the felt can be identified. In various manners, the area of a felt location may also be defined such as by assigning a radius or diameter to the grid location or by assigning one or more additional grid points to define an area or the location can define the near center of the area of interest and the engine can search, detect, and store the boundaries of the printed borders of each area of interest. Any resolution may be selected by adjusting the number of points in the X and Y axis. For example, the area of the rightmost felt location 1408 in FIG. 14 may be defined by assigning the radius or diameter of the felt location to the grid location 1404 at its center.

FIG. 15 illustrates a sample spreadsheet outlining the resulting felt coordinates that define the locations of the various aspects of the felt and locations of items on the table or felt. A first column group shows the game attributes, which are control parameters for the particular game. The second column group provides ownership attributes, such as who owns the game. The third column defines the image or felt coordinates that define the areas of interest. As shown, the reference points for the grid are shown and thereafter, the felt coordinate locations for the other aspects of the table, such as the primary wager locations, the side wager locations, and the secondary wager locations. Other locations may be defined, such as the expected area of the card shoe, token buy in area, card locations, player token locations, payout locations and slot locations. The fourth column group may contain jurisdictions approval or regulatory information.

In reference to FIG. 14 and FIG. 15, by overlaying a coordinate grid over the table, every location or area on the table may be identified by grid coordinates. Relevant locations on the table may be assigned grid coordinates to identify that relevant table location in grid coordinates. Relevant table locations may comprise acceptable dealer working areas, betting locations, card locations, table peripheral locations, or any other table location or game item location. Using RFID, overhead monitoring, or both, the resulting RFID data or image data may be mapped into the grid. By comparing and contrasting the known location of relevant locations on the table with the RFID or table image, which has been mapped onto the grid, items such as cards, wagers, peripherals, or any other item placed on the table can thus be associated with an area on the table. Once associated with that area, using common grid coordinates, the wager may be associated with particular player positions, or a type of wager, such as a standard wager, bonus wager, progressive wager, secondary, tertiary wager, etc. Thus, for example, wagers placed at grid coordinates 70, 16, 0 are known to be at primary player position 1. If payouts are all made directly to the right of the wager, then any payout placed and detected directly to the right of the grid coordinates 70, 16, 0 can be associated with the primary wager for player position one. This is discussed below in greater detail. As a result of the grid coordinate system set forth herein, events occurring on the table may be detected and assigned grid coordinates, and cross referenced against known grid coordinates for the table to associates the event with a particular game event.

In addition, a peripheral located at a particular grid coordinate may be identified as a particular peripheral based on its location at a grid location that is assigned to the peripheral. For example, a shuffler may be placed at 70, 5, 0 location. Thus, when the RFID or image system detects something at 70, 5, 0, the engine may conclude that whatever is at that location is the shuffler. Other means for identifying the shuffler are also possible in the event the shuffler is moved to accommodate a dealer.

Figure 16:
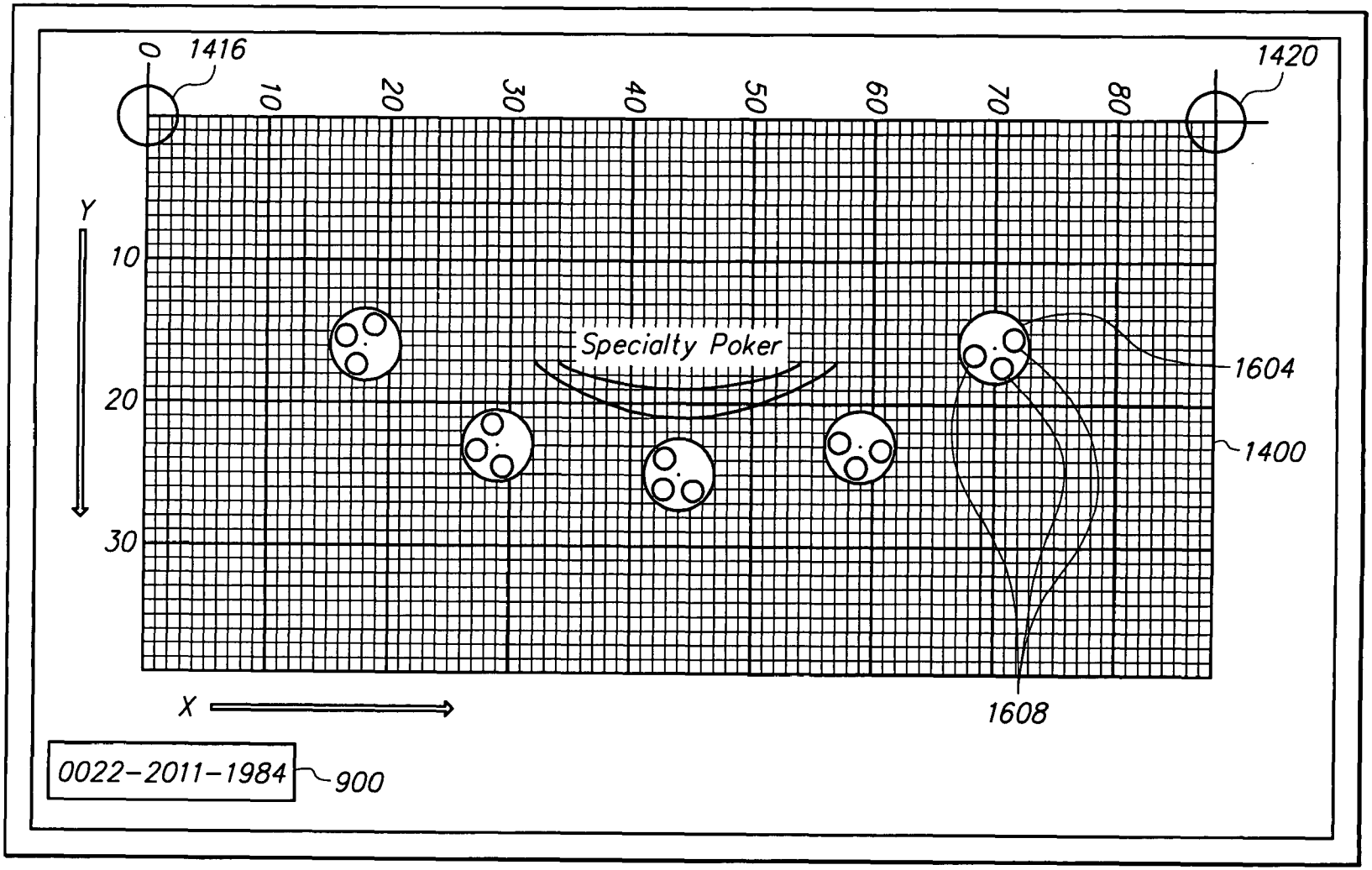
FIG. 16 illustrates another embodiment of a coordinate grid system overlaid on a gaming table.

FIG. 16 illustrates another embodiment of a coordinate grid system 1400 overlaid on a gaming table. It is contemplated that due to limitations in the resolution and allowed proximity of RFID antennas, and the limitations of space on a gaming table, multiple betting locations may have to be located within a single RFID antenna coverage location. In FIG. 16, this is shown as RFID antenna coverage area 1604. Within this coverage area are three betting locations 1608. Due to limitations or for other reasons, the area of betting locations 1608 may not be capable of being monitored by individual antennas. As such, a single antenna coverage 1604 will be used to monitor the three wagering areas 1608.

Using overhead monitors and the grid arrays, the wagering areas 1608 may be monitored individually. Using image analysis, each betting area of the three bet locations 1608 can be distinguished based on the imaged area. The grid location of the wager is compared to the known grid locations for each wager area to determine at which known locations the wager was placed. The engine may thus determine where the wager was placed. The amount of the wager may also be determined by the image system or the RFID system.

FIG. 17 illustrates a spreadsheet of control parameters including the wagers placed and shown in FIG. 16. As shown in FIG. 17, the third column group shows the primary wager location and other wagers locations. These wager locations are compared to where the wagers are actually placed to determine where the wager was placed and the type of wager. This process, using the grid coordinates at the guiding map, allows the image data to be translated into actual 'type of bet' information.

Figure 18:
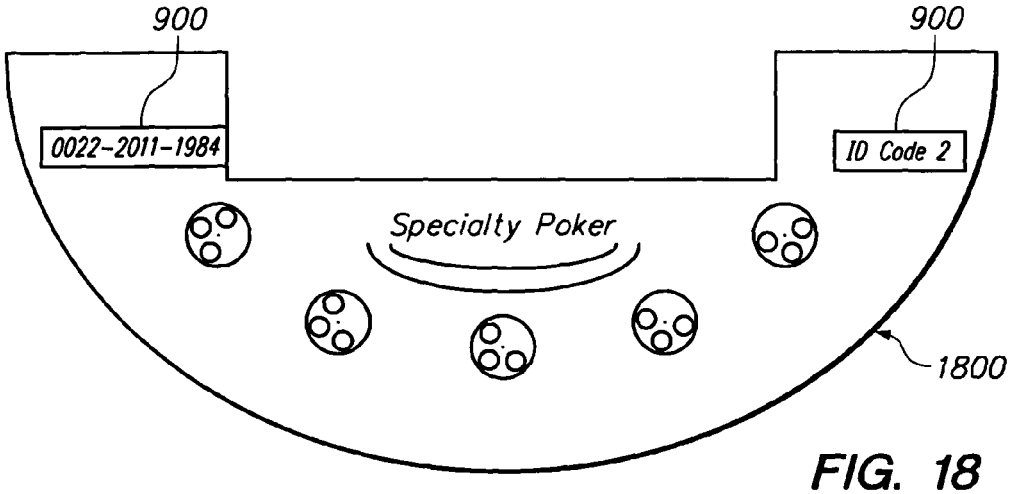
FIG. 18 illustrates an example table insert with a felt printing.
Figure 19:
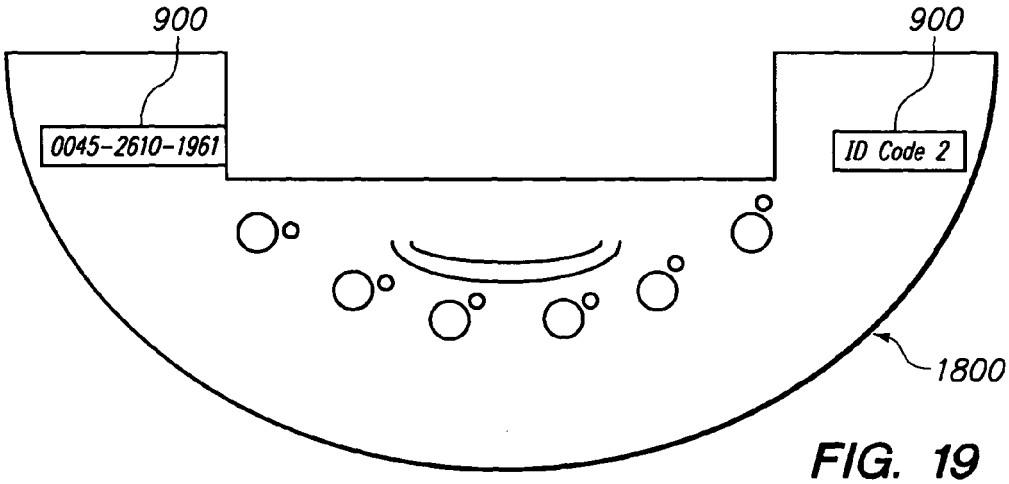
FIG. 19 illustrates an example table insert with another felt printing.
Figure 20:
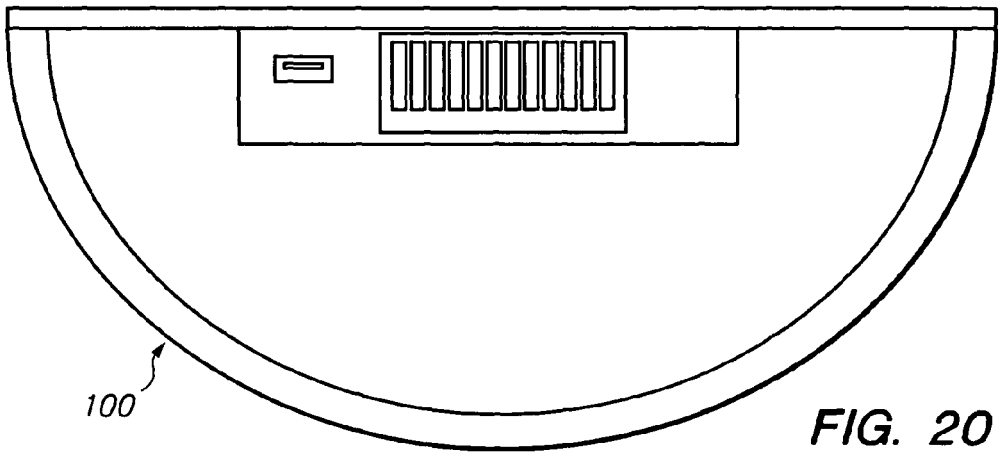
FIG. 20 illustrates an example table configured to contain a table insert.

FIGS. 18, 19, and 20 illustrate examples of table inserts 1800 with felt printing and an example table 100 configured to contain the table inserts. FIG. 18 illustrates a second side of a table insert 1800 with felt configured for specialty poker. This table insert side has the table identification 900 as shown. FIG. 19 illustrates a first side of a table insert having a different table identification 900 than shown for the second side of FIG. 18. Additionally, ID code 2 may be the same or different for each side. FIG. 20 illustrates a table which may accept the inserts 1800 of FIG. 18 and FIG. 19. The inserts 1800 may be a single insert with different felts on each side. By flipping the felt, the same table may be used, but two different games offered and each game may have a different ID code. By having table identifications 900 on each side of the table, the game in play may be easily and optionally automatically programmed into the table monitoring system.

Figure 21:
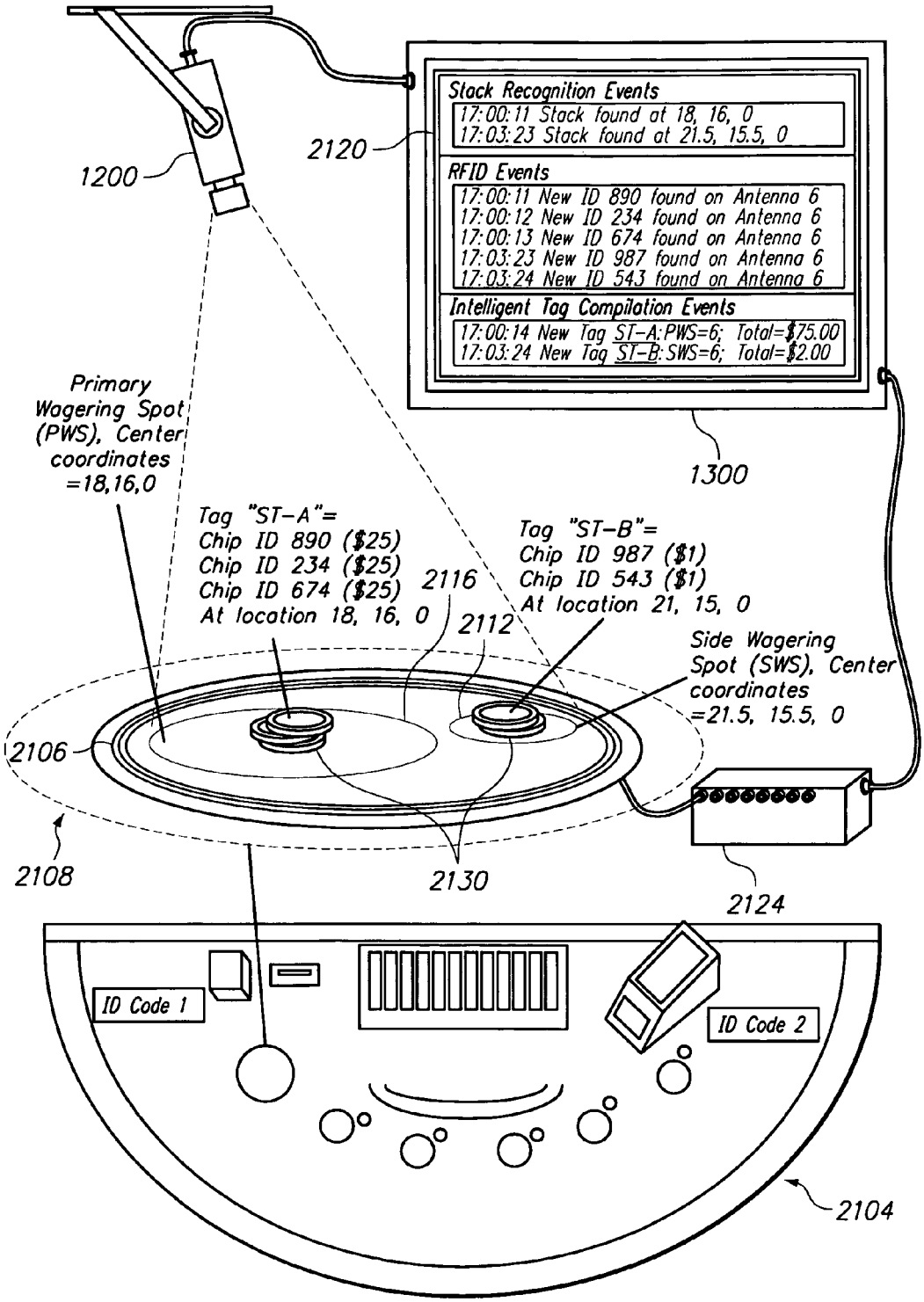
FIG. 21 illustrates a perspective view of a gaming table and an expanded view of an example wager area.

FIG. 21 illustrates a perspective view of a game table with expanded view of a wager area with image monitoring. As shown, a game table 2104 is equipped as may be understood based on the disclosure herein and the understanding of one of ordinary skill in the art. Enlarged wager area 2108 comprises a single RFID antenna 2106 for token monitoring. In this embodiment, the RFID antenna 2106 is connected to a RFID reader 2124.

Contained within the wager area 2108 are two wager locations 2116 and 2112. The single antenna RFID system is not capable of detecting upon which of the two wager areas 2112, 2116 the wager was placed. To account for this limitation, an overhead camera 1200 is configured to generate an image of the table and wager/cards thereon.

The predetermined and known table coordinates and the image data, and the mapping on to the grid to obtain grid coordinates for the wagers is shown in the figure associated with each wager and in the resulting table monitoring data shown in engine data 2120. The engine data comprises data collected from the wagering system. It comprises a combination of RFID data, chip ID numbers and location data. The time that the wager is places may be recorded by the system. In this manner, using a single RFID antenna for multiple wagering locations, and a camera/image monitoring system, the wagers may be accurately tracked. The RFID system provides information regarding the chip (token) serial number and denomination amount and in which antenna the wager is placed. Time information is also provided. The image information may be mapped into grid coordinates to determine upon which particular wagering area (within the detection zone of a single RFID antenna) the token was placed. Time information may also be provided with the image information. By cross-referencing this information, precise wager tracking may occur.

The engine data 2120 shows the types of data which may be collected from the single RFID antenna area with image tracking. In the embodiment of FIG. 21, the engine data 2120 is shown displayed on a table or image controller's 1300 screen. However, it is contemplated that in one or more embodiments, the engine data 2120 may not be displayed at all or may be displayed via another device or devices.

The stack recognition event log shows the time and grid location for the separate stacks 2130 in the wager areas 2116, 2112. The RFID event log shows the RFID data collected when each stack 2130 is placed on the table. By cross-referencing these logs, and using the data as a reference, precise monitoring of the wagers placed in each wager area 2116, 2112 is possible even though both wager areas are within a single RFID antenna area.

Figure 22:
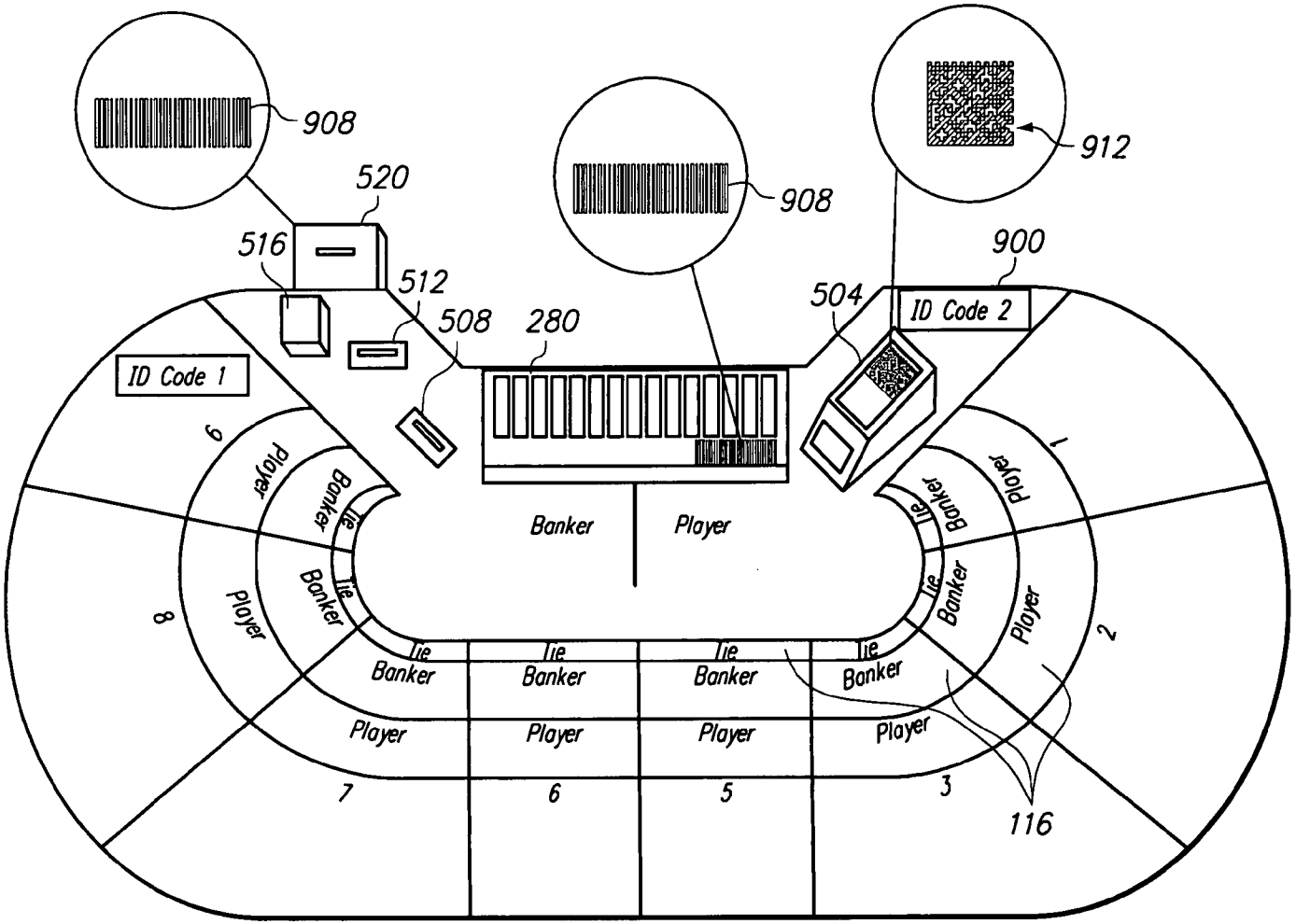
FIG. 22 illustrates an overhead view of a gaming table with peripheral identification.

FIG. 22 illustrates an overhead view of a gaming table with peripheral identification. In this embodiment, the peripheral devices are assigned identifications, such as ID codes. These codes may comprise any type or format code described above. By assigning an identification code to each or one or more peripheral device, the identification code of the peripheral may be entered into or automatically detected by the monitoring system. This allows the monitoring system to know the exact peripheral in use and how to interface with and interpret the data received from the peripheral. This further automates the monitoring system and system operation. If the peripheral identification is placed with the peripheral, and monitored by RFID or image monitoring, then if the peripheral is moved, the table monitoring system will automatically detect the movement of the peripheral and configured the engine accordingly. The peripheral may have a pre-stored peripheral control parameters associated therewith, such as in a data file, that defines how the engine interfaces with the peripheral. Authorized and un-authorized peripherals may be detected.

In operation, it is farther contemplated that tagging may occur to facilitate and provide means for tracking. Tagging is defined herein as a system and method for the engine to associate a unique identifier with a wager or other table occurrence to thereby track the wager or occurrence during play. By assigning a tag to the event, such as for example, the wager tag may be used to track the wager. Other occurrences on the table, such as movement of the wager, may be tracked as being associated with the original tag. Payouts to the wager may also be assigned as sub-events associated with the tag, or create a new tag that is associated with or linked to the original wager.

In one embodiment the tag represents or contains all of the information associated with the event or game piece, such as wager. This may include but is not limited to player tracking card location, wager location, wager amount, wager time, wager token ID, game phase when wager was made, and player position of wager. In certain games, this wager may be moved to different locations on the table, or re-wagered by leaving the original wager on the table. Assigning a tag to the wager to represent the wager and the associated data, provides a simplified manner for the engine to track the tag.

If the wager or other element leaves the felt, the tag may expire, be closed, or continue to be tracked. The system may also discontinue tracking a tag if a wager or other element leaves the felt. Generally, an element leaves the felt when it is taken off the table such as when winnings are paid to a player and the player takes the tokens comprising the winnings off the gaming table. However, leaving the felt may also mean that the element is no longer relevant to the play of the game and thus in some embodiments an element may leave the felt without physically being taken off the table. It is contemplated that, tracking may be resumed if the wager or other element reenters the felt.

A data file may store the tag data and the tracking system may graphically or non-graphically utilize the tag to track table events. Use of a tag may minimize hardware by reducing the number of RFID antennas needed per player seat, for example, to monitor and track each betting option for a game such as baccarat, without using a tagging method as described, the RFID system will need to have a minimum of three separate antennas per betting option, which are typically Player, Banker and Tie bets per player seat. The tagging function will allow one antenna in combination of the imaging data to provide the needed information to distinguish each betting option per player seat made during each game. The tagging function will also allow an easier method to separately track and distinguish all bets made per betting option and per player seat as seen and practiced as backline, or simply, back betting. It is contemplated that the tagging function may be based solely on timing of the movement, adding, or subtracting wagers within one or more known periods of the game. Back betting is such that allows gamblers to wager behind or for the player which are seated at the gaming table.

In one embodiment, a wager may be tagged and payouts to that wager may also be tagged. Comparison between tag data and the pay out data may occur to verify that the payout is the proper match for the wager based on table or game parameters, such as payout rates, and to verify that the proper wager was paid. Linking a tag to a wager provides the benefit of distinguishing that each wager is credited and accumulated for each individual player. Linking a tag to a payout provides the advantage of monitoring and distinguishing the actual winnings of each player and thus provides a more accurate means of game and player tracking.

The following provides additional information and disclosure regarding the subject matter disclosed herein. As is understood, casinos around the world offer fast pace, high volume gambling activity on a wide variety of live action table games. This fast pace, high volume live gaming environment is vulnerable to various cheating methods that are performed by gamblers and employees that wish to gain an unfair advantage over the casino. In addition, casino management may desire to track game play to improve casino operation and casino management.

Currently, the technology disclosed herein can be used to create a table game monitoring apparatus that will expand upon the casino's toolset to accurately monitor and report all data regarding how a live table game has been played. In addition to reporting the historic data, the technology allows the monitoring apparatus to report real time events that may indicate that some sort of cheating or game play outside the rules of the game has occurred. The software may monitor, report, and store most if not all data associated with each live table game on a casino floor.

In general terms, within the field of view, the Overhead Optical Engine will provide real time data and events based on game piece placements and movements. In addition, the Optical Engine will provide environmental data that describes game attributes along with the available administrative items installed on the table.

For the purpose of this document, game pieces are defined as all the pieces and items that allow a live game to be played from its beginning to its full conclusion. In addition, there are administrative items that casino personnel use on a regular basis that helps to manage the operation of the gaming table between and during games and may or may not have any direct relationship to the game play. Generally, game pieces can be categorized as wagering pieces, playing pieces, and administration items.

Wagering pieces are the physical items that the player will use to place bets with. The player will usually place these pieces in a predefined area within the playing area of the game. These wagering items can simply be gaming chips, tokens, plagues, or real currency such as paper money or coin. Playing pieces are the devices that are used during the game play that will determine the final outcome of the actual game being played. These devices can be playing cards, dice, balls (in conjunction with a roulette wheel), or tiles. Administrative items can be categorized as either static or dynamic items. The static items will typically be items such as the felt layout, drop box slot, discard rack, or tip box slot. The dynamic pieces would be items such as the cut card, roulette marker, player rating cards, or in some cases, special devices used by the dealer to indicate the current state of the game being played or the actual outcome of the game.

Also disclosed herein is Optical Engine Logic. The Optical Engine logic will use image capturing hardware and electronics along with the proper recognition algorithms in order to distinguish all game piece items on a live table game in a real time manner. The Optical Engine may be configured to: a) provide data on command that describes the administrative components installed on the game, b) provide an event when it senses the presence of any new game pieces, c) provide an event when a previously detected game piece has moved from one zone to another, d) provide an event when any previously recognized and tagged item has been removed from the field of view of the image capturing hardware, and e) provide a game piece change of state event. Each event will provide the administrative data that will include time stamp data and the normal packet wrappers.

Also disclosed herein is Administrative Component Data. Administrative components can be defined as either being static or dynamic items. Static types are items that remain constant throughout any game cycle and may infrequently. Static items can be felt layouts, chip trays, the slot of the drop box and tip box, a discard rack, a card shoe, etc. Dynamic types are items that are intermittent and may not be used during each game cycle. One such item could be the shuffle card that indicates when a new shuffle is needed for the shoe.

The static items may be the components that will be more detailed as the concept is such that will allow automatic configuration and association of game engines to physical tables based on the optical engine decoding the static components. The main component to define is the felt layout as follows:

- Felt ID encoding and may include a unique serial number, model number, and printed version of felt, which may further define the following:
  - Expected betting zones per betting spot and player position.
  - Expected game piece types and placements.
  - Two dimensional grid granularity definition to be either fine, medium, or course. (This defines how many different zones are available in the field of view of the image capturing hardware where fine has more zones than medium and medium has more zones than course.)
  - Game type, which will detail the game rules and procedures.
  - Printing company that made the felt.
- Datum of North, South, East, and West of the layout. As an example, North would define the player side, South would define dealer side and east and west define the right and left of the table from the perspective of the dealer.
- Post felt installation tag that would define the date of felt installation and table number as examples.

The next components are items such as the chip tray, drop box and tip box slots, and other devices that are permanent or semi-permanent static items. These items can be marked with an encoding that the optical engine can easily decode. The encoding may at a minimum include a unique serial number per item. The optical engine should also include the zone in which each item has been detected. In the case of the chip tray and chip tray cover, the optical engine should provide events when the chip tray cover has either been removed or replaced (both events are useful to detect openers and closers of the game along with providing a security alert each time the chip tray cover has been removed).

Also disclosed herein is a New Game Piece Event. A New Game Piece Event may be formatted to include; a) a unique tag ID of the new item placed in the field of view, b) the game piece class, c) the game piece data (if applicable), d) the game piece state, e) the geographic location of the game piece, and f) the administrative details of the event.

Unique Tag ID

The unique tag ID (UTID) number could be based off a random number or a sequential number. However, regardless the method of assigning an ID number, UTID and will be unique for that game cycle and, ideally throughout a definable minimum period of time.

Game Piece Class

The game piece class defines the category in which the new game piece falls into. The game pieces classes can be grouped as follows:

- Wagering pieces such as gaming chips.
- Playing pieces such as playing cards, dice, wheels, tiles, etc.
- Administration items such as felt layouts, chip trays, drop boxes, tip boxes, etc.

Game Piece Data

The game piece data defines the value (if applicable) of the new game piece. This data could be the value of the playing card or the value of each rolled dice.

Game Piece State

The game piece state is reserved for items such as playing cards to detail whether the card is face up face down. This will allow the image capturing hardware and software to keep track of this type of device until the card has been turned over.

Game Piece Location

The game piece location data details the physical location of where the new game piece has been placed.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A table monitoring system for monitoring one or more table games comprising:

a camera configured to create a table image and image data;

a RFID system configured to create RFID data;

a processing engine configured to execute machine readable code;

a memory configured to store machine readable code, the machine readable code configured to:

process the image data and the RFID data to create one or more tags wherein at least one tag represents a table event and has associated therewith the image data and the RFID data;

process the at least one tag against one or more control parameters which correspond to a table game generate and output an alert.

2. The table monitoring system of claim 1 further comprising a table identification on or in a table on which the table game is played, wherein the camera, REID system, or both detect the table identification to select control parameters.

3. The table monitoring system of claim 1, wherein the alert is provided to a dealer or casino personal via a computer display.

4. The table monitoring system of claim 3 wherein the machine readable code further comprises a coordinate grid mapping module having one or more grid coordinates assigned to one or more relevant locations, wherein the machine readable code is configured to map the image data and the RFID data to the coordinate grid and assign the image data and the RFID data to at least one of the one or more tags based on the coordinate mapping.

5. The table monitoring system of claim 1 further comprising a biometric interface configured to create player identification data, wherein the machine readable code is configured to associate the player identification data with at least one of the relevant locations of the coordinate grid.

6. The table monitoring system of claim 1 further comprising one or more peripherals in communication with the processing engine, the one or more peripherals having an identification code associated therewith, wherein the processing engine is configured to assign table events related to the one or more peripherals to at least one of the one or more tags.

7. A table monitoring system for monitoring one or more table games comprising:

a table having a felt, the felt having at least one felt identification;

one or more control parameters associated with the at least one felt identification;

a RFID system configured to create RFID data in response to one or more table events, the RFID system having one or more RFID antennas and a detection zone for each RFID antenna; and a processing engine configured to execute machine readable code;

a memory in communication with the processing engine, the memory configured to store control parameters and with machine readable code configured to:

process RFID data;

establish a coordinate grid having one or more grid coordinates associated with one or more relevant table locations;

map the processed RFID data to at least one of the one or more grid coordinates and to create one or more tags, wherein the RFID data is associated with at least one of the one or more tags based on the coordinate mapping.

8. The table monitoring system of claim 7 further comprising:

a camera configured to create a plurality of table images; and an image controller configured to create image data by analyzing the plurality of table images and identifying relevant locations of the one or more table games and the table events of the one or more table games;

wherein the machine readable code is further configured to map the RFID data and the image data to at least one of the one or more grid coordinates and to create the one or more tags, the RFID data and the image data being associated with at least one of the one or more tags based on the coordinate mapping.

9. The table monitoring system of claim 8 further comprising a plurality of independent bet locations within the detection zone, wherein the image controller is configured to identify one or more table events occurring in any of the independent bet locations and wherein the machine readable code is further configured to distinguish the one or more table events occurring in any of the bet locations by cross-referencing the image data and the RFID data.

10. The table monitoring system of claim 8 wherein the machine readable code is configured to associate the image data and the RFID data created during play of the one or more table games to at least one of the one or more tags and the machine readable code is further configured to generate an alert if the tag violates a control parameter.

11. The table monitoring system of claim 8, wherein the machine readable code is configured to assign the RFID data and the image data to at least one of the one or more tags based on a time at which one or more table events occurred.

12. The table monitoring system of claim 7 further comprising a memory configured to store database of the RFID data, the image data, or both.

13. A method of electronically monitoring a table game comprising:

creating RFID data in response to one or more table events detected by one or ore RFJD antennas, each of the RFID antennas having a detection zone;

creating image data by analyzing a plurality of table images;

mapping the RFID data, the image data, or both to a coordinate grid;

cross-referencing the RFID data and the image data;

creating one or more tags, wherein at least one tag represents at least one of the one or more table events and has the RFID data, the image data, or both associated herewith.

14. The method of claim 13 further comprising associating additional RFID data, additional image data, or both with at least one of the one or more tags already created by the processing engine as the table game is played.

15. The method of claim 13 wherein the RFID data, image data, or both is associated with at least one of the one or more tags based on the coordinate mapping, time, or both.

16. The method of claim 13 further comprising identifying one or more players and associating at least one relevant location on the coordinate grid to an identified player.

17. The method of claim 13 further comprising:

receiving at least one felt identification associated with a felt on which the table game is played; and associating data with the one or more tags according to one or more control parameters, wherein the control parameters correspond to the at least one felt identification.

18. The method of claim 13 further comprising distinguishing each of the one or more table events occurring within the detection zone by cross-referencing the RFID data and the image data.

19. The method of claim 13 further comprising discontinuing tracking of at least one of the one or more tags when an item with which the tag is associated leaves the table.

* * * * *